US010439302B2

(12) United States Patent
Youtsey

(10) Patent No.: US 10,439,302 B2
(45) Date of Patent: Oct. 8, 2019

(54) CONNECTING DEVICE FOR CONNECTING AND GROUNDING COAXIAL CABLE CONNECTORS

(71) Applicant: PCT International, Inc., Mesa, AZ (US)

(72) Inventor: Timothy Lee Youtsey, Scottsdale, AZ (US)

(73) Assignee: PCT International, Inc., Mesa, AZ (US)

( * ) Notice: Subject to any disclaimer, the term of this patent is extended or adjusted under 35 U.S.C. 154(b) by 0 days.

(21) Appl. No.: 15/972,014

(22) Filed: May 4, 2018

(65) Prior Publication Data

US 2018/0358718 A1 Dec. 13, 2018

Related U.S. Application Data

(60) Provisional application No. 62/517,047, filed on Jun. 8, 2017, provisional application No. 62/609,980, filed on Dec. 22, 2017.

(51) Int. Cl.
*H01R 9/05* (2006.01)
*H01R 43/20* (2006.01)
(Continued)

(52) U.S. Cl.
CPC ..... *H01R 9/0512* (2013.01); *H01R 9/0524* (2013.01); *H01R 9/0527* (2013.01);
(Continued)

(58) Field of Classification Search
CPC .. H01R 9/0512; H01R 9/0524; H01R 9/0527; H01R 9/05; H01R 13/6583;
(Continued)

(56) References Cited

U.S. PATENT DOCUMENTS 2,233,216 A 2/1941 Matthysse
2,304,711 A 12/1942 Shenton
(Continued)

FOREIGN PATENT DOCUMENTS

CN 201117964 Y 9/2008
DE 3111832 A1 10/1982
(Continued)

OTHER PUBLICATIONS

"F-type connectors", ShowMe Cables, dated 2007 and printed on Jul. 9, 2008, 1 page, located at: http://www.showmecables.com/F-Type-Connectors.html.
(Continued)

*Primary Examiner* — Khiem M Nguyen
(74) *Attorney, Agent, or Firm* — Perkins Coie LLP

(57) ABSTRACT

A connecting device configured to be installed on a first coaxial cable connector to facilitate connection of the first connector to a second connector and to maintain ground continuity across the connectors. In some embodiments, the connecting device includes a grounding element disposed in a gripping member, the grounding element including one or more projections configured to extend beyond an end of the gripping member to conductively engage an outer surface of the second connector.

20 Claims, 13 Drawing Sheets

(51) Int. Cl.
*H01R 13/6583* (2011.01)
*H01R 24/54* (2011.01)
*H01R 13/6598* (2011.01)
*H01R 13/622* (2006.01)

(52) U.S. Cl.
CPC ..... *H01R 13/6583* (2013.01); *H01R 24/542* (2013.01); *H01R 43/20* (2013.01); *H01R 13/622* (2013.01); *H01R 13/6598* (2013.01)

(58) Field of Classification Search
CPC .... H01R 24/542; H01R 43/20; H01R 13/622; H01R 13/6598
USPC ..... 439/92, 101, 322, 578
See application file for complete search history.

(56) References Cited

U.S. PATENT DOCUMENTS

D140,861 S 4/1945 Conlan
3,274,447 A 9/1966 Nelson
3,275,737 A 9/1966 Caller
3,344,227 A 9/1967 Gilmartin et al.
3,366,920 A 1/1968 Laudig et al.
3,390,374 A 6/1968 Forney, Jr.
3,489,988 A 1/1970 Carnaghan
3,517,375 A 6/1970 Mancini
3,544,705 A 12/1970 Winston
3,601,776 A 8/1971 Curl
3,609,651 A 9/1971 Sladek et al.
3,653,689 A 4/1972 Sapy et al.
3,671,922 A 6/1972 Zerlin et al.
3,708,781 A 1/1973 Trompeter
3,740,453 A 6/1973 Callaghan et al.
3,746,931 A 7/1973 Muranaka
3,777,298 A 12/1973 Newman
3,778,535 A 12/1973 Forney, Jr.
3,836,700 A 9/1974 Niemeyer
3,863,111 A 1/1975 Martzloff
3,953,097 A 4/1976 Graham
4,159,859 A 7/1979 Shemtov
4,225,162 A 9/1980 Dola
4,307,926 A 12/1981 Smith
4,377,320 A 3/1983 Lathrop et al.
4,400,050 A 8/1983 Hayward
4,408,822 A 10/1983 Nikitas
4,509,090 A 4/1985 Kawanami et al.
RE31,995 E 10/1985 Ball
4,572,692 A 2/1986 Sauber
4,619,497 A 10/1986 Vogel et al.
4,633,359 A 12/1986 Mickelson et al.
4,684,201 A 8/1987 Nutter
4,718,854 A 1/1988 Capp et al.
4,755,152 A 7/1988 Elliot et al.
4,875,864 A 10/1989 Campbell
4,915,651 A 4/1990 Bout
4,941,846 A 7/1990 Guimond
4,990,106 A 2/1991 Szegda
5,011,432 A 4/1991 Sucht et al.
5,031,981 A 7/1991 Peterson
5,041,020 A 8/1991 Michael
5,067,750 A 11/1991 Minneman
5,073,129 A 12/1991 Szegda
5,083,943 A 1/1992 Tarrant
5,096,444 A 3/1992 Lu et al.
5,123,863 A 6/1992 Frederick et al.
5,141,448 A 8/1992 Mattingly et al.
5,145,382 A 9/1992 Dickirson
5,147,221 A 9/1992 Cull et al.
5,161,993 A 11/1992 Leibfried, Jr.
5,195,905 A 3/1993 Pesci
5,195,910 A 3/1993 Enomoto et al.
5,198,958 A 3/1993 Krantz, Jr.
5,205,547 A 4/1993 Mattingly
5,217,393 A 6/1993 Del Negro et al.
5,237,293 A 8/1993 Kan et al.
5,276,415 A 1/1994 Lewandowski et al.
5,281,167 A 1/1994 Le et al.
5,284,449 A 2/1994 Vaccaro
5,295,864 A 3/1994 Birch et al.
5,297,458 A 3/1994 Smith
5,306,170 A 4/1994 Luu
5,316,348 A 5/1994 Franklin
5,318,458 A 6/1994 Thorner
5,367,925 A 11/1994 Gasparre
5,439,399 A 8/1995 Spechts et al.
5,466,173 A 11/1995 Down
5,470,257 A 11/1995 Szegda
5,498,175 A 3/1996 Yeh et al.
5,507,537 A 4/1996 Meisinger et al.
5,525,076 A 6/1996 Down
5,548,088 A 8/1996 Gray et al.
5,564,938 A 10/1996 Shenkal et al.
5,595,499 A 1/1997 Zander et al.
5,607,325 A 3/1997 Toma
5,632,633 A 5/1997 Roosdorp et al.
5,632,651 A 5/1997 Szegda
5,651,698 A 7/1997 Locati et al.
5,660,565 A 8/1997 Williams
5,667,409 A 9/1997 Wong et al.
5,694,233 A 12/1997 Wu et al.
5,700,160 A 12/1997 Lee
5,724,165 A 3/1998 Wu
5,724,220 A 3/1998 Chaudhry
5,730,622 A 3/1998 Olson
5,829,992 A 11/1998 Merker et al.
5,830,010 A 11/1998 Miskin et al.
5,857,711 A 1/1999 Comin-DuMong et al.
5,860,833 A 1/1999 Chillscyzn et al.
5,863,226 A 1/1999 Lan et al.
5,865,654 A 2/1999 Shimirak et al.
5,867,291 A 2/1999 Wu et al.
5,882,233 A 3/1999 Idehara
5,905,942 A 5/1999 Stoel et al.
5,912,748 A 6/1999 Wu et al.
5,927,975 A 7/1999 Esrock
5,938,465 A 8/1999 Fox, Sr.
5,953,195 A 9/1999 Pagliuca
5,963,291 A 10/1999 Wu et al.
5,978,116 A 11/1999 Wu et al.
5,984,378 A 11/1999 Ostrander et al.
5,991,136 A 11/1999 Kaczmarek et al.
5,992,010 A 11/1999 Zamanzadeh
6,005,697 A 12/1999 Wu et al.
6,010,349 A 1/2000 Porter, Jr.
6,011,218 A 1/2000 Burek et al.
6,027,373 A 2/2000 Gray et al.
6,042,422 A 3/2000 Youtsey
6,048,233 A 4/2000 Cole
6,065,997 A 5/2000 Wang
6,071,144 A 6/2000 Tang
6,109,963 A 8/2000 Follingstad et al.
6,113,431 A 9/2000 Wong
6,118,912 A 9/2000 Xu
6,134,358 A 10/2000 Wu et al.
6,137,606 A 10/2000 Wu et al.
6,140,582 A 10/2000 Sheehan
6,142,788 A 11/2000 Han
6,146,196 A 11/2000 Burger et al.
6,160,665 A 12/2000 Yuan
6,163,393 A 12/2000 Wu et al.
6,166,838 A 12/2000 Liu et al.
6,174,206 B1 1/2001 Yentile et al.
6,175,432 B1 1/2001 Wu et al.
RE37,044 E 2/2001 Wu
6,183,297 B1 2/2001 Kay et al.
6,183,298 B1 2/2001 Henningsen
6,201,593 B1 3/2001 Wong et al.
6,208,442 B1 3/2001 Liu et al.
6,208,444 B1 3/2001 Wong et al.
6,210,221 B1 4/2001 Maury
6,210,222 B1 4/2001 Langham et al.
6,243,200 B1 6/2001 Zhou et al.
6,249,415 B1 6/2001 Daoud et al.
6,250,960 B1 6/2001 Youtsey

(56) References Cited

U.S. PATENT DOCUMENTS 6,337,934 B1 1/2002 Wu et al.
6,396,367 B1 5/2002 Rosenberger
6,396,609 B1 5/2002 Cheng et al.
D459,306 S 6/2002 Malin
6,425,782 B1 7/2002 Holland et al.
6,426,816 B1 7/2002 Wu et al.
D461,167 S 8/2002 Montena
6,429,962 B1 8/2002 Xu et al.
6,450,836 B1 9/2002 Youtsey
6,455,841 B2 9/2002 Zhou et al.
6,468,100 B1 10/2002 Meyer et al.
6,474,201 B1 11/2002 Lund
6,510,004 B1 1/2003 Wu et al.
6,512,615 B2 1/2003 Wu et al.
6,515,786 B1 2/2003 Xia et al.
6,519,022 B1 2/2003 Xu et al.
6,519,060 B1 2/2003 Liu
6,545,783 B1 4/2003 Wu et al.
6,552,833 B2 4/2003 Liu et al.
6,559,992 B2 5/2003 Zhou et al.
6,591,055 B1 7/2003 Eslambolchi et al.
6,600,582 B1 7/2003 Liu et al.
6,621,632 B2 9/2003 Zhou
6,623,180 B2 9/2003 Panicker et al.
6,645,819 B2 11/2003 Pullela
6,648,683 B2 11/2003 Youtsey
6,690,846 B2 2/2004 Zhou et al.
6,712,631 B1 3/2004 Youtsey
6,767,247 B2 7/2004 Rodrigues
6,776,657 B1 8/2004 Hung
6,798,310 B2 9/2004 Wong et al.
6,808,415 B1 10/2004 Montena
6,810,171 B2 10/2004 Zhou et al.
6,817,272 B2 11/2004 Holland
6,847,786 B2 1/2005 Wong et al.
6,877,996 B1 4/2005 Franks, Jr.
6,879,749 B2 4/2005 Wong et al.
6,887,102 B1 5/2005 Burris
D508,676 S 8/2005 Franks, Jr.
6,960,918 B2 11/2005 Hazelton
6,972,826 B1 12/2005 Xu et al.
7,006,279 B2 2/2006 Liu et al.
7,018,235 B1 3/2006 Burris
7,021,947 B1 4/2006 Purdy
7,023,611 B2 4/2006 Huang et al.
7,034,979 B1 4/2006 Feng et al.
7,052,283 B2 5/2006 Pixley et al.
7,080,946 B2 7/2006 Bachl et al.
7,125,283 B1 10/2006 Lin
7,131,868 B2 11/2006 Montena
7,144,273 B1 12/2006 Chawgo
7,147,509 B1 12/2006 Burris et al.
7,181,999 B1 2/2007 Skeels et al.
7,183,743 B2 2/2007 Geiger
7,198,495 B1 4/2007 Youtsey
7,210,940 B2 5/2007 Baily et al.
7,249,970 B1 7/2007 Wei
7,306,484 B1 12/2007 Mahoney et al.
7,311,555 B1 12/2007 Burris et al.
7,347,129 B1 3/2008 Youtsey
7,384,307 B1 6/2008 Wang
7,404,737 B1 7/2008 Youtsey
7,476,127 B1 1/2009 Wei
7,497,729 B1 3/2009 Wei
7,500,874 B2 3/2009 Montena
7,513,795 B1 4/2009 Shaw
7,544,094 B1 6/2009 Paglia et al.
7,566,236 B2 7/2009 Malloy et al.
RE41,044 E 12/2009 Hung
7,635,283 B1 12/2009 Islam
7,674,132 B1 3/2010 Chen
7,785,144 B1 8/2010 Islam
7,806,725 B1 10/2010 Chen
7,824,216 B2 11/2010 Purdy
7,837,501 B2 11/2010 Youtsey
7,841,912 B2 11/2010 Hachadorian
7,845,978 B1 12/2010 Chen
7,850,487 B1 12/2010 Wei
7,857,661 B1 12/2010 Islam
7,874,870 B1 1/2011 Chen
7,876,579 B1 1/2011 Tsau
7,887,354 B2 2/2011 Holliday
7,892,024 B1 2/2011 Chen
7,909,614 B1 3/2011 Chang
7,938,680 B1 5/2011 Hsieh
7,952,891 B2 5/2011 Tsau
7,997,930 B2 8/2011 Ehret
8,016,605 B2 * 9/2011 Montena ..... H01R 13/622 439/322
8,016,612 B2 9/2011 Burris et al.
8,029,315 B2 10/2011 Purdy et al.
8,029,316 B2 10/2011 Snyder
8,062,064 B2 11/2011 Rodrigues et al.
8,065,940 B2 11/2011 Wilson
8,075,338 B1 12/2011 Montena
8,079,860 B1 12/2011 Zraik
8,081,879 B2 12/2011 Shou et al.
8,100,704 B1 1/2012 Wei
8,113,875 B2 2/2012 Malloy et al.
8,113,879 B1 2/2012 Zraik
8,137,134 B1 3/2012 Chang
8,145,059 B2 3/2012 Yu
8,152,551 B2 4/2012 Zraik
8,157,588 B1 4/2012 Rodrigues
8,157,589 B2 4/2012 Krenceski
8,172,611 B1 5/2012 Montena
8,206,176 B2 6/2012 Islam
8,231,412 B2 7/2012 Paglia et al.
8,262,409 B2 9/2012 Chang
8,280,260 B2 10/2012 Shou et al.
8,298,020 B1 10/2012 Chen
D670,749 S 11/2012 Chien
D670,750 S 11/2012 Chien
8,303,338 B2 11/2012 Chen
8,310,310 B2 11/2012 Lao et al.
8,337,229 B2 12/2012 Montena
8,342,879 B2 1/2013 Amidon
8,388,377 B2 3/2013 Zraik
8,414,313 B2 4/2013 Rodrigues
8,444,327 B2 5/2013 Chen
8,444,445 B2 5/2013 Amidon
8,465,322 B2 6/2013 Purdy
D686,573 S 7/2013 Wu
8,490,525 B2 7/2013 Wilson
8,511,912 B2 8/2013 Wu
8,517,764 B2 8/2013 Wei et al.
8,545,112 B2 10/2013 Chien
8,568,164 B2 10/2013 Ehret
8,568,165 B2 10/2013 Wei
8,641,297 B2 2/2014 Wu et al.
8,646,992 B2 2/2014 Chen et al.
8,783,970 B2 7/2014 Wu
8,794,111 B2 8/2014 Wang
8,794,113 B2 8/2014 Maury
8,808,019 B2 8/2014 Paglia et al.
8,864,519 B2 10/2014 Wei
8,920,182 B2 12/2014 Montena
8,920,192 B2 12/2014 Montena
8,961,230 B2 2/2015 Chou
9,027,446 B1 5/2015 Simkin
9,028,276 B2 * 5/2015 Wilson ..... H01R 9/0524 439/578
9,059,528 B2 6/2015 Wang
9,252,882 B2 2/2016 Chien et al.
9,306,324 B2 4/2016 Wei
9,343,855 B2 5/2016 Wei
9,362,666 B2 6/2016 Laughlin
9,375,831 B2 6/2016 Wang
9,435,711 B2 9/2016 Wu
9,448,373 B2 9/2016 Kropp
9,456,533 B2 9/2016 Lan et al.
9,571,219 B2 2/2017 Wang et al.
9,577,391 B2 * 2/2017 Wilson ..... H01R 9/0524
9,635,788 B2 4/2017 Tsau

(56) References Cited

U.S. PATENT DOCUMENTS

| | | | | |
|---|---|---|---|---|
| 9,730,362 | B2 | 8/2017 | Chen | |
| 2002/0076954 | A1 | 6/2002 | Chen et al. | |
| 2002/0090856 | A1 | 7/2002 | Weisz-Margulescu | |
| 2003/0046706 | A1 | 3/2003 | Rakib | |
| 2003/0075671 | A1 | 4/2003 | Liu | |
| 2003/0075672 | A1 | 4/2003 | Liu | |
| 2003/0075713 | A1 | 4/2003 | Pullela et al. | |
| 2003/0076861 | A1 | 4/2003 | Dharia et al. | |
| 2003/0077049 | A1 | 4/2003 | Dharia et al. | |
| 2003/0077849 | A1 | 4/2003 | Liu et al. | |
| 2003/0094688 | A1 | 5/2003 | Dharia et al. | |
| 2003/0113063 | A1 | 6/2003 | Liu | |
| 2004/0048514 | A1 | 3/2004 | Kodaira | |
| 2004/0112356 | A1* | 6/2004 | Hatcher | F41B 11/52 124/41.1 |
| 2004/0194585 | A1 | 10/2004 | Clark | |
| 2005/0148236 | A1 | 7/2005 | Montena | |
| 2005/1027231 | | 12/2005 | Tsao | |
| 2006/0013541 | A1 | 1/2006 | Plickert et al. | |
| 2006/0041922 | A1 | 2/2006 | Shapson | |
| 2006/0110094 | A1 | 5/2006 | Bachl et al. | |
| 2006/0154522 | A1 | 7/2006 | Bernhart et al. | |
| 2006/0172571 | A1* | 8/2006 | Montena | H01R 9/0518 439/91 |
| 2008/0066584 | A1 | 3/2008 | Vines | |
| 2008/0311790 | A1 | 12/2008 | Malloy et al. | |
| 2008/0313691 | A1 | 12/2008 | Cholas et al. | |
| 2008/0318469 | A1 | 12/2008 | Paglia | |
| 2009/0203255 | A1 | 8/2009 | Chu | |
| 2010/0022120 | A1 | 1/2010 | Bradley | |
| 2010/0099300 | A1 | 4/2010 | Hsieh | |
| 2010/0233902 | A1 | 9/2010 | Youtsey | |
| 2010/0297875 | A1 | 11/2010 | Purdy et al. | |
| 2011/0287653 | A1 | 11/2011 | Youtsey | |
| 2011/0318958 | A1 | 12/2011 | Burris et al. | |
| 2012/0045933 | A1 | 2/2012 | Youtsey | |
| 2012/0129387 | A1 | 5/2012 | Holland et al. | |
| 2012/0145450 | A1 | 6/2012 | Lan et al. | |
| 2012/0192359 | A1 | 8/2012 | Wang | |
| 2012/0257206 | A1 | 10/2012 | Wang et al. | |
| 2012/0288237 | A1 | 11/2012 | Chen et al. | |
| 2012/0288244 | A1 | 11/2012 | Wu et al. | |
| 2012/0295464 | A1 | 11/2012 | Youtsey | |
| 2012/0295465 | A1 | 11/2012 | Youtsey | |
| 2012/0295466 | A1 | 11/2012 | Youtsey | |
| 2013/0029513 | A1 | 1/2013 | Montena | |
| 2013/0064504 | A1 | 3/2013 | Chien | |
| 2013/0128594 | A1 | 5/2013 | Chien | |
| 2013/0130544 | A1 | 5/2013 | Wei | |
| 2013/0143438 | A1 | 6/2013 | Wilson et al. | |
| 2013/0330040 | A1 | 12/2013 | Wu | |
| 2014/0051285 | A1 | 2/2014 | Raley et al. | |
| 2015/0111429 | A1 | 4/2015 | Hoyak et al. | |
| 2015/0295368 | A1 | 10/2015 | Wilson | |
| 2015/0325932 | A1 | 11/2015 | Ehret | |
| 2015/0340819 | A1 | 11/2015 | Chen | |
| 2016/0223393 | A1 | 8/2016 | Hsu et al. | |
| 2016/0226233 | A1 | 8/2016 | Chen | |
| 2017/0279206 | A1 | 9/2017 | Chen | |
| 2018/0054017 | A1 | 2/2018 | Watkins et al. | |

FOREIGN PATENT DOCUMENTS

| | | | |
|---|---|---|---|
| GB | 2079549 | A | 1/1982 |
| JP | 64002263 | | 1/1989 |
| JP | 2299182 | C | 12/1990 |
| JP | 5347170 | A | 12/1993 |
| TW | 570415 | U | 1/2004 |
| TW | I297633 | B | 6/2008 |
| WO | 9310578 | A1 | 5/1993 |
| WO | 2011146911 | A1 | 11/2011 |
| WO | 2012158343 | A1 | 11/2012 |
| WO | 2012158344 | A1 | 11/2012 |
| WO | 2012158345 | A1 | 11/2012 |

OTHER PUBLICATIONS

"Pico/Macom GRB-I" and "Pico/Macom GRB-2" single and dual coax cable ground blocks, Stallions Satellite and Antenna—Grounding Products, dated Nov. 9, 2005 and printed Aug. 17, 2011, 3 pgs., located online at: http://web.archive.org/web/20051109024213/http://tvantenna.com/products/installation/grounding.html.

Latest quality F-connector Supply Information, China Quality F Connector list, Hardware-Wholesale.com, printed on Jul. 9, 2008, 6 pages, located at: http://www.hardware-wholesale.com/buy-F_Connector/.

Complaint, Connecticut Litigation Case No. 3:12-cv-01468-AVC, filed Oct. 15, 2012, 19 pgs.

File History of U.S. Pat. No. 7,544,094 issued Jun. 9, 2009, 123 pgs.

Declaration of James Dickens, Ph.D. re U.S. Pat. No. 7,544,094 patent, with Curriculum Vitae, Apr. 2, 2013, 35 pages.

Holden, G. et al., "Applications of Thermoplastic Elastomers", Thermoplastic Elastomers, Hanser Gardner Publications, Inc., 2004, 3 pgs.

Pasternack Enterprises, LLC, Catalog #2003-SA, 2003, pp. 171-172.

* cited by examiner

CONNECTING DEVICE FOR CONNECTING AND GROUNDING COAXIAL CABLE CONNECTORS

CROSS-REFERENCE TO RELATED APPLICATIONS

This application claims priority to U.S. Provisional Patent Application No. 62/517,047, titled "CONNECTING DEVICE FOR CONNECTING AND GROUNDING COAXIAL CABLE CONNECTORS," filed Jun. 8, 2017, and U.S. Provisional Patent Application No. 62/609,980, titled "CONNECTING DEVICE FOR CONNECTING AND GROUNDING COAXIAL CABLE CONNECTORS," filed Dec. 22, 2017, each of which is incorporated herein by reference in its entirety.

TECHNICAL FIELD

The following disclosure relates generally to devices for facilitating connection, reducing RF interference, and/or grounding of F-connectors and other cable connectors.

APPLICATIONS INCORPORATED BY REFERENCE

Each of the following is incorporated herein by reference in its entirety: U.S. patent application Ser. No. 12/382,307, titled "JUMPER SLEEVE FOR CONNECTING AND DISCONNECTING MALE F CONNECTOR TO AND FROM FEMALE F CONNECTOR," filed Mar. 13, 2009, now U.S. Pat. No. 7,837,501; U.S. patent application Ser. No. 13/707,403, titled "COAXIAL CABLE CONTINUITY DEVICE," filed Dec. 6, 2012, now U.S. Pat. No. 9,028,276; U.S. patent application Ser. No. 14/684,031, titled "COAXIAL CABLE CONTINUITY DEVICE," filed Apr. 10, 2015, now U.S. Pat. No. 9,577,391; and U.S. patent application Ser. No. 15/058,091, titled "COAXIAL CABLE CONTINUITY DEVICE," filed Mar. 1, 2016.

BACKGROUND

Electrical cables are used in a wide variety of applications to interconnect devices and carry audio, video, and Internet data. One common type of cable is a radio frequency (RF) coaxial cable ("coaxial cable") which may be used to interconnect televisions, cable set-top boxes, DVD players, satellite receivers, and other electrical devices. A conventional coaxial cable typically consists of a central conductor (usually a copper wire), dielectric insulation, and a metallic shield, all of which are encased in a polyvinyl chloride (PVC) jacket. The central conductor carries transmitted signals while the metallic shield reduces interference and grounds the entire cable. When the cable is connected to an electrical device, interference may occur if the grounding is not continuous across the connection with the electrical device.

A connector, such as an "F-connector" (e.g., a male F-connector), is typically fitted onto an end of the cable to facilitate attachment to an electrical device. Male F-connectors have a standardized design, using a hexagonal rotational connecting ring with relatively little surface area available for finger contact. The male F-connector is designed to be screwed onto and off of a female F-connector using the fingers. In particular, internal threads within the connecting ring require the male connector to be positioned exactly in-line with the female F-connector for successful thread engagement as rotation begins. However, the relatively small surface area of the rotational connecting ring of the male F-connector can limit the amount of torque that can be applied to the connecting ring during installation. This limitation can result in a less than secure connection, especially when the cable is connected to the device in a location that is relatively inaccessible. As a result, vibration or other movement after installation can cause a loss of ground continuity across the threads of the male and female F-connectors. Moreover, the central conductor of the coaxial cable can often build up a capacitive charge prior to being connected to an electrical device. If the central conductor contacts the female F-connector before the male F-connector forms a grounded connection with the female F-connector, the capacitive charge can discharge into the electrical device. In some circumstances, the capacitive discharge can actually damage the electrical device.

Accordingly, it would be advantageous to facilitate grounding continuity across cable connections while also facilitating the application of torque to, for example, a male F-connector during installation.

BRIEF DESCRIPTION OF THE DRAWINGS

Many aspects of the present disclosure can be better understood with reference to the following drawings. The components in the drawings are not necessarily to scale. Instead, emphasis is placed on clearly illustrating the principles of the present disclosure.

DETAILED DESCRIPTION

Figure 1A:
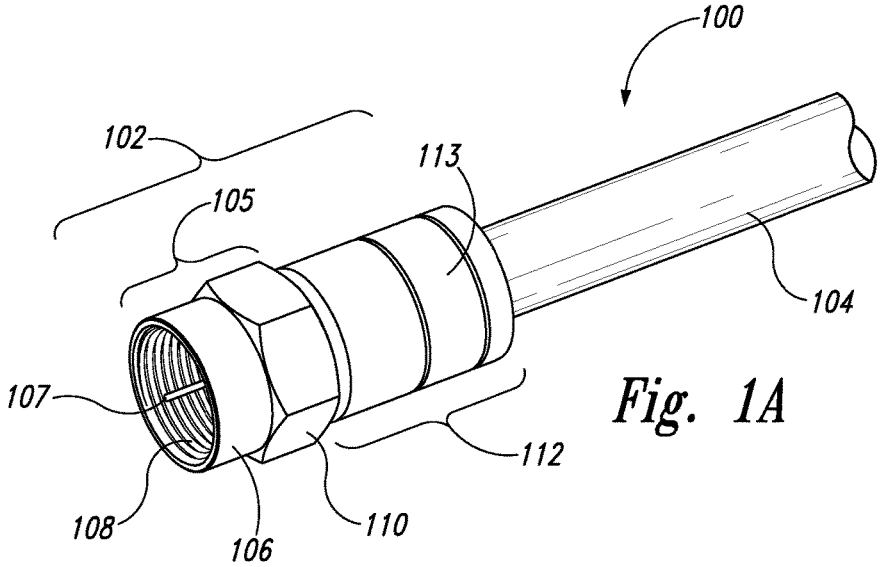
FIG. 1A is an isometric view of a coaxial cable assembly having a male connector.

The following disclosure describes devices, systems, and associated methods for facilitating connection of a first coaxial cable connector to a second coaxial cable connector, for maintaining ground continuity across coaxial cable connectors, and/or for reducing RF interference of a signal carried by one or more coaxial cables. For example, some embodiments of the present technology are directed to a connecting device having a jumper sleeve for easily connecting and disconnecting a male coaxial cable connector ("male cable connector") to and from a female coaxial cable connector ("female cable connector"). The connecting device can further include a grounding element disposed at least partially in the jumper sleeve for establishing and/or maintaining ground path continuity between the male cable connector and the female cable connector before and after attachment. In some embodiments, the grounding element includes a conductive projection (e.g., a prong) that extends past an end of the jumper sleeve to conductively contact a portion of the female cable connector before the male cable connector contacts the female connector.

Certain details are set forth in the following description and in FIGS. 1A-13B to provide a thorough understanding of various embodiments of the disclosure. Those of ordinary skill in the relevant art will appreciate, however, that the technology disclosed herein can have additional embodiments that may be practiced without several of the details described below and/or with additional features not described below. In addition, some well-known structures and systems often associated with coaxial cable connector systems and methods have not been shown or described in detail below to avoid unnecessarily obscuring the description of the various embodiments of the disclosure.

The dimensions, angles, features, and other specifications shown in the figures are merely illustrative of particular embodiments of the disclosure. Accordingly, other embodiments can have other dimensions, angles, features, and other specifications without departing from the scope of the present disclosure. In the drawings, identical reference numbers identify identical, or at least generally similar, elements.

FIG. 1A is an isometric view of a conventional coaxial cable assembly 100 having a first connector 102 (e.g., a coaxial cable connector) attached to an end portion of a coaxial cable 104. The coaxial cable 104 has a central conductor 107. In the illustrated embodiment, the first connector 102 can be a male F-connector including a rotatable connecting ring 105 rotatably coupled to a sleeve 112. In other embodiments, however, the first connector 102 can be any suitable cable connector. The rotatable connecting ring 105 can have a threaded inner surface 108 and an outer surface having a first outer surface portion 106 and a second outer surface portion 110. The first outer surface portion 106 can have a generally circular cylinder shape, while the second outer surface portion 110 can have a plurality of flat sides forming, for example, a generally hexagonal shape (referred to herein as "hexagonal surface 110"). However, in other embodiments, the first and second outer surface portions 106, 110 can have different shapes and/or relative sizes, or the first outer surface portion 106 can be omitted. The sleeve 112 has an outer surface 113, and is pressed onto an exposed metal braid (not shown) on the outer surface of the coaxial cable 104 in a manner well known in the art.

Figure 1B:
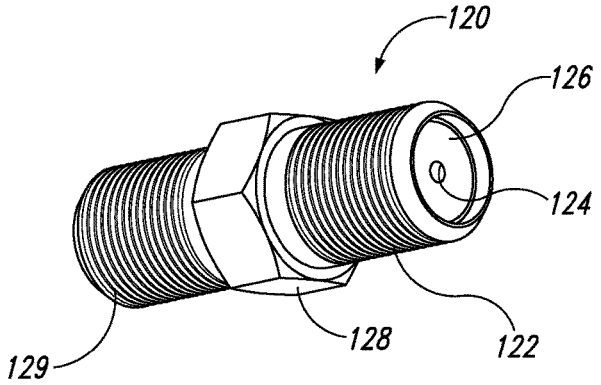
FIG. 1B is an isometric view of a female coaxial cable connector.

FIG. 1B is an isometric view of a second connector 120 (e.g., a female F-connector) configured to be threadably engaged with the male F-connector 102 of the coaxial cable assembly 100 shown in FIG. 1A. More specifically, the female F-connector 120 has a first threaded outer surface 122 configured to engage the threaded inner surface 108 of the male F-connector 102, and an aperture 124 formed in a conductive receptacle 126. The aperture 124 is configured to receive the central conductor 107 of the male F-connector 102. In some embodiments, the female F-connector 120 can include other features, such as a hexagonal outer surface 128 and a second threaded outer surface 129. The hexagonal outer surface 128 can provide a gripping surface that facilitates the application of torque for threadably engaging the second threaded outer surface 129 with, for example, a coaxial cable connector for a television or other electronic device.

Figure 1C:
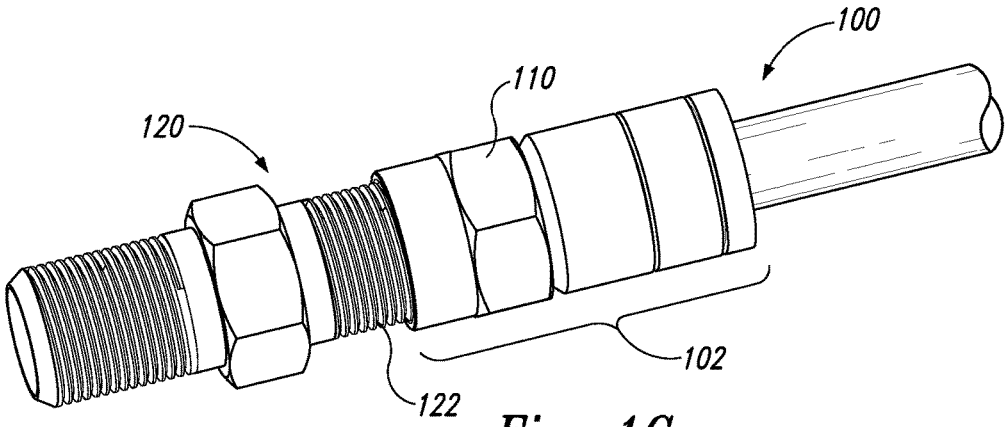
FIG. 1C is an isometric view of the male connector of FIG. 1A connected to the female connector of FIG. 1B.

FIG. 1C is an isometric view of the coaxial cable assembly 100 of FIG. 1A with the male F-connector 102 threadably connected to the female F-connector 120. By way of example, a user can install the male F-connector 102 by applying torque to the hexagonal surface 110 of the male F-connector 102 to screw the male F-connector 102 onto the female F-connector 120. Once installed, the central conductor 107 is received in the aperture 124 and the threaded inner surface 108 of the male F-connector 102 engages the threaded outer surface 122 of the female F-connector 120 to provide a ground path between the connectors 102, 120. However, in some scenarios—for example, where the connectors 102, 120 are not properly aligned—the connection between the connectors 102, 120 can be less than secure after attachment. As a result subsequent vibration or movement can a cause a significant reduction or loss of ground continuity.

Figure 2:
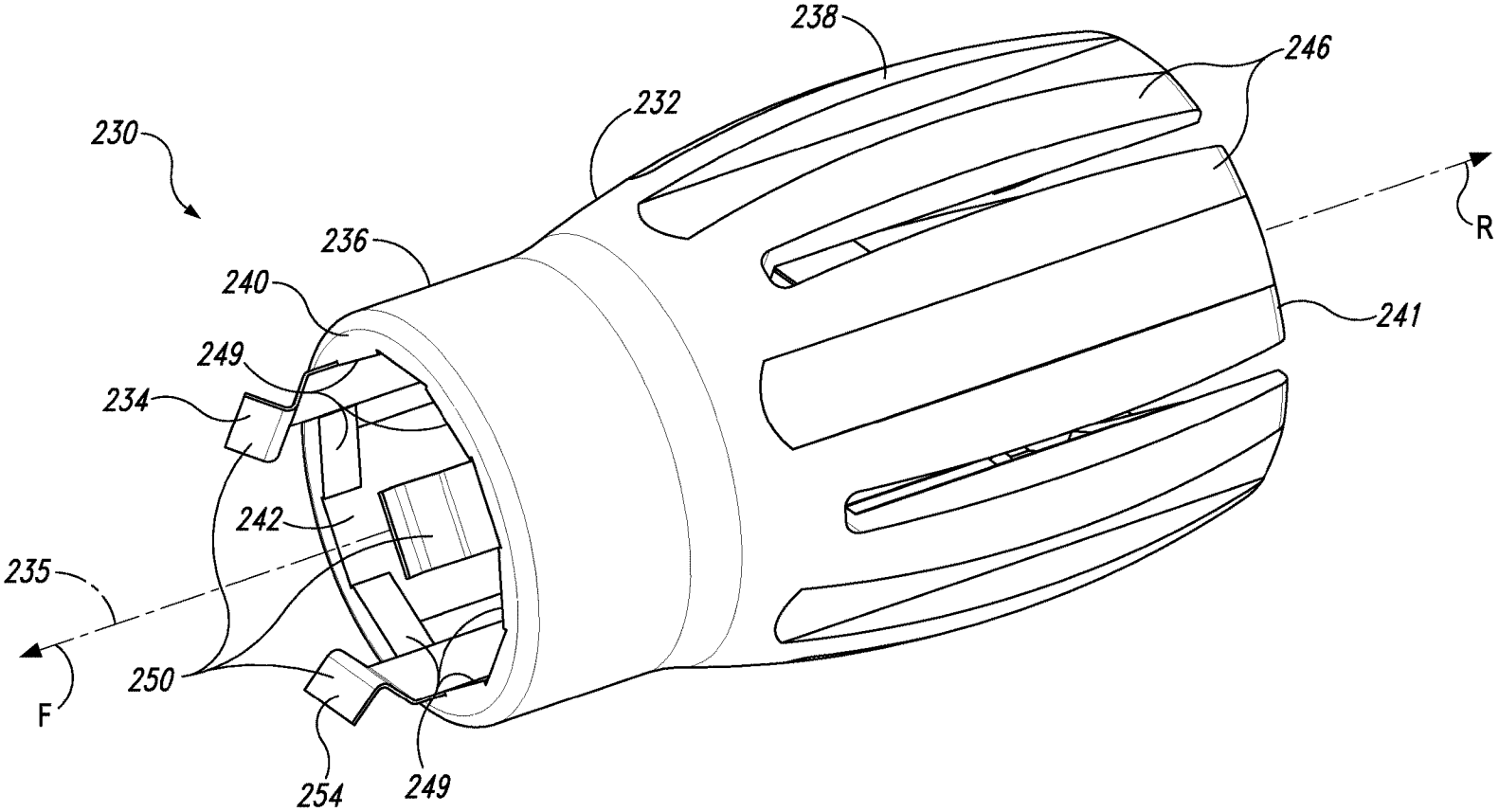
FIG. 2 is a front isometric view of a connecting device configured in accordance with an embodiment of the present technology.

FIG. 2 is an isometric view of a connecting device 230 configured in accordance with an embodiment of the present technology. In the illustrated embodiment, the connecting device 230 includes a hollow gripping member, referred to herein as jumper sleeve 232, having a central axis 235 and configured to facilitate connection between two coaxial cable connectors. The jumper sleeve 232 includes a wrench portion 236 and a grip portion 238. The wrench portion 236 has a forward edge 240 and a shaped inner surface 242 configured to receive and at least partially grip an outer surface of a coaxial cable connector. For example, in the illustrated embodiment, the inner surface 242 has a complimentary hexagonal shape for snugly receiving the hexagonal surface 110 of the connecting ring 105 shown in FIG. 1A. In other embodiments, the inner surface 242 can have other shapes and features to facilitate receiving and/or gripping coaxial cable connectors having different shapes. As described in further detail below, the grip portion 238 extends from the wrench portion 236 toward a rear edge 241, and can have one or more grip members 246. The grip members 246 extend away from the wrench portion in a direction R, and can provide a gripping surface for applying torque to the rotatable connecting ring 105 of the male F-connector 102 received in the wrench portion 236. The jumper sleeve 232 and various aspects thereof can be at least generally similar to the juniper sleeves disclosed in U.S. patent application Ser. No. 12/382,307, titled "JUMPER SLEEVE FOR CONNECTING AND DISCONNECTING MALE F CONNECTOR TO AND FROM FEMALE F CONNECTOR," filed Mar. 13, 2009, now U.S. Pat. No. 7,837,501; U.S. patent application Ser. No. 13/707,403, titled "COAXIAL CABLE CONTINUITY DEVICE," filed Dec. 6, 2012, now U.S. Pat. No. 9,028,276; U.S. patent application Ser. No. 14/684,031, titled "COAXIAL CABLE CONTINUITY DEVICE," filed Apr. 10, 2015, now U.S. Pat. No. 9,577,391; and U.S. patent application Ser. No. 15/058,091, titled "COAXIAL CABLE CONTINUITY DEVICE," filed Mar. 1, 2016, each of which is incorporated herein by reference in its entirety.

The connecting device 230 also includes a grounding element 234 that can be removably or permanently installed at least partially within the jumper sleeve 232. The grounding element 234 is made from a conductive resilient material and includes one or more projections (which can also be referred to as tines, tangs, or prongs 250) that extend outward in a direction F at least partially beyond the forward edge 240 of the wrench portion 236. In the illustrated embodiment, for example, the grounding element 234 includes three prongs 250. Each prong 250 can have an elongate body extending generally parallel to the central axis 235 of the jumper sleeve 232, and an end portion 254 that extends at least partially beyond the forward edge 240 and radially inward toward the central axis 235. When the connecting device 230 is used to connect the male F-connector 102 to the female F-connector 120, as described below, at least a portion of each prong 250 conductively contacts at least a portion of the male F-connector 102, and the end portions 254 conductively contact at least a portion of the female F-connector 120 to maintain ground path continuity between the two connectors.

Figure 3:
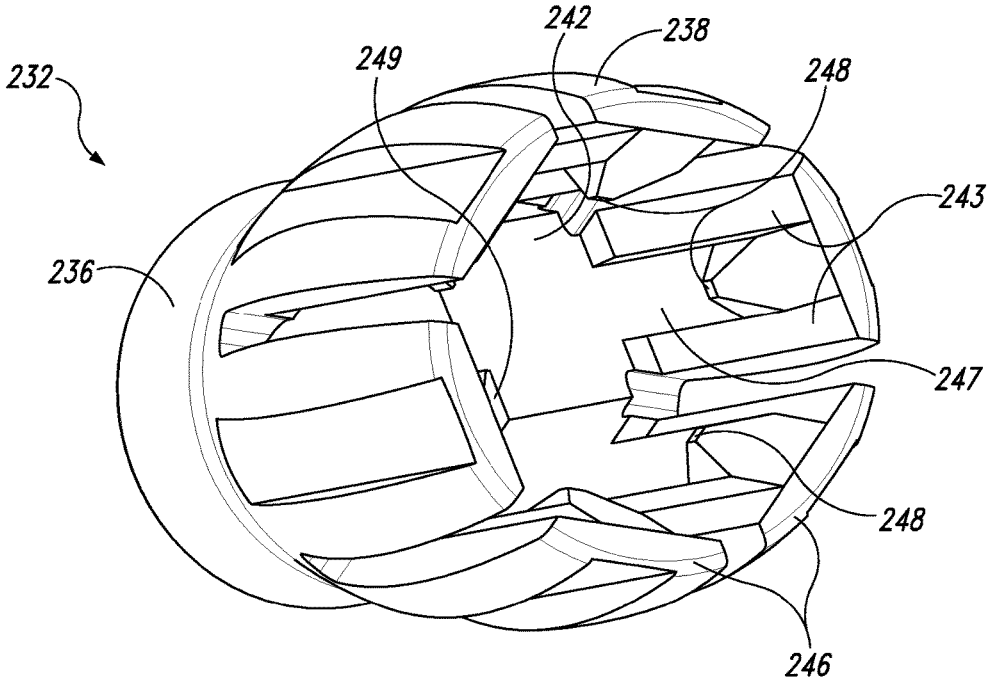
FIG. 3 is a rear isometric view of a jumper sleeve of the connecting device of FIG. 2 configured in accordance with an embodiment of the present technology.

FIG. 3 is a rear isometric view of the jumper sleeve 232 prior to installation of the grounding element 234. In the illustrated embodiment, the grip portion 238 has a cask-shape with a plurality of (e.g., six) convex grip members 246 extending outwardly from the wrench portion 236. For example, the grip members 246 can be cantilevered from the wrench portion 236. In other embodiments, the grip portion 238 can include one or more grip members 246 having different shapes (e.g., concave, angular, etc.), and/or fewer or more than the six grip members 246 shown in FIG. 3. In some embodiments, individual grip members 246 can be omitted, and instead the grip portion 238 can include a single cylindrical member. When the male F-connector 102 (FIG. 1A) is inserted into the jumper sleeve 232, the grip members 246 allow for application of a greater torque to the rotatable connecting ring 105 than could otherwise be achieved by direct manual rotation of the hexagonal surface 110 of the male F-connector 102.

In the illustrated embodiment, each grip member 246 includes two recesses 243 on opposite sides of a raised surface 247, and a key portion 248 projecting inwardly from the raised surface 247 and toward the central axis 235 (FIG. 2). As described in further detail below, the raised surface 247 and recesses 243 are shaped and sized to selectively receive a portion of the grounding element 234. The key portions 248 are configured to abut a portion of the male F-connector 102 (e.g., an edge of the sleeve 112) to retain the male F-connector 102 in the jumper sleeve 232 and prevent the male F-connector 102 from moving out of the jumper sleeve 232 in the direction R (FIG. 2). Similarly, one or more shoulder portions 249 (best seen in FIG. 2) extend between adjacent "flats" of the hexagonal inner surface 242 proximate to the forward edge 240, and are configured to abut the forward edge of the connecting ring 105 to prevent the male F-connector 102 from moving out of the jumper sleeve 232 in the direction F (FIG. 2). The jumper sleeve 232 can be made from, for example, plastic, rubber, metal, and/or other suitable materials using methods well known in the art.

Figure 4:
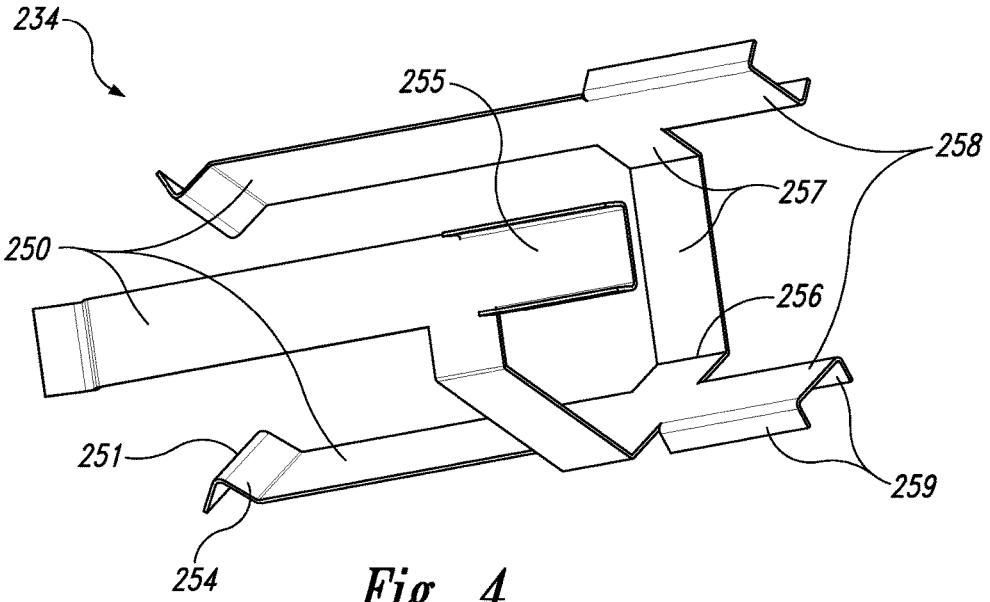
FIG. 4 is a rear isometric view of a grounding element of the connecting device of FIG. 2 configured in accordance with an embodiment of the present technology.

FIG. 4 is an isometric view of the grounding element 234 configured in accordance with an embodiment of the present technology. The grounding element 234 includes the prongs 250, a base portion 256, and one or more engagement features 258. More specifically, the base portion 256 can have a plurality of flat sides 257 forming, for example, a hexagonal shape to facilitate fitting within the complimentary recess in the jumper sleeve 232. In some embodiments, the base portion 256 does not form a continuous ring. For example, in the illustrated embodiment, the base portion 256 includes only five sides 257 such that the base portion 256 has an open hexagonal shape. In other embodiments, the base portion 256 can be formed to have any other suitable shape (e.g., a polygon, a circle, etc.), and can include any number of suitable sides. The prongs 250 extend outward away from the base portion 256, and the end portions 254 are shaped (e.g., bent) to extend inwardly. In some embodiments, the end portions 254 can have an angled or chevron-like shape profile including an apex 251 that is configured to engage the threaded outer surface 122 of the female F-connector 120 (FIG. 1B).

Each of the engagement features 258 can include one or more flanges 259 projecting radially outward from a web surface 255. The web surfaces 255 of the individual engagement features 258 are configured to snugly receive the raised surface 247 of a corresponding grip member 246 (FIG. 3), while the flanges 259 are configured to insert into the recesses 243 on the outer sides of the raised surface 247 to prevent rotational movement of the grounding element 234 relative to the jumper sleeve 232. Furthermore, outer edge portions of the individual engagement features 258 are positioned to abut the opposing face of the respective key portions 248 (FIG. 3). The key portions 248 can thereby prevent movement of the grounding element 234 in direction R relative to the jumper sleeve 232. In the illustrated embodiment, the grounding element 234 includes three prongs 250 longitudinally aligned with corresponding engagement features 258. In other embodiments, however, the prongs 250 and engagement features 258 can have different configurations (e.g., different numbers, alignment, and/or shapes).

In some embodiments, the grounding element 234 can be formed from a resilient conductive material, e.g., a metallic material, that is suitably elastic to flex in response to external forces experienced in use. In some such embodiments, the prongs 250, base portion 256, and/or engagement features 258 can be formed so that—when the grounding element 234 is not installed in the jumper sleeve 232—the grounding element 234 has a net outside diameter (or other cross-sectional dimension) that is slightly greater than the outside diameter of the mating surface of the jumper sleeve 232. This requires the grounding element 234 to be radially compressed slightly to fit within the jumper sleeve 232, and provides an outward spring bias against the jumper sleeve 232 to provide a snug fit of the grounding element 234. In other embodiments, the grounding element 234 can be secured within the jumper sleeve 232 via other means. For example, the grounding element 234 can be cast into, adhesively bonded, welded, fastened, or otherwise integrated or attached to the jumper sleeve 232 during or after manufacture. Moreover, in some embodiments, one or more of the prongs 250 can be formed so that they extend radially inward to contact (and exert a biasing force against) at least a portion of the male F-connector 102 and/or female F-connector 120 when the two connectors are engaged. The grounding element 234 can be made from any suitable conductive material such as, for example, copper beryllium, brass, phosphor bronze, stainless steel, etc., and can have any suitable thickness. For example, in some embodiments, the grounding element 234 can have a thickness of from about 0.001 inch to about 0.032 inch, or about 0.003 inch to about 0.020 inch. In some embodiments, each prong 250 can be integrally formed with a corresponding engagement feature 258, and/or the entire grounding element 234 can be formed from a single piece of conductive material. In other embodiments, the grounding element 234 can be formed from multiple pieces of material. Furthermore, although there is one grounding element 234 depicted in the illustrated embodiment, in other embodiments, two or more grounding elements 234 having the same or a different configurations may be positioned within the jumper sleeve 232.

Figure 5A:
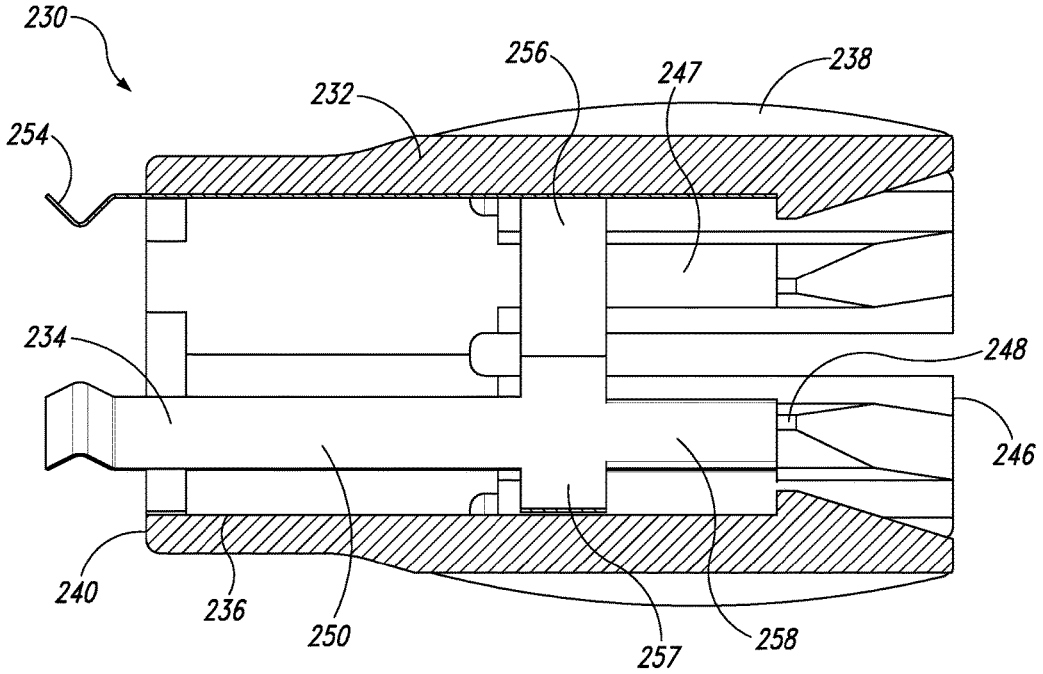
FIG. 5A is a cross-sectional side view of the connecting device of FIG. 2.

FIG. 5A is a cross-sectional side view of the connecting device 230 having the grounding element 234 installed in the jumper sleeve 232 in accordance with an embodiment of the present technology. As described above, the grounding element 234 is securely positioned within the jumper sleeve 232 (via, e.g., an interference fit) with the engagement features 258 for receiving the raised surfaces 247 of respective grip members 246. The base portion 256 can also be positioned within the grip portion 238 of the jumper sleeve 232. In some embodiments, the hexagonally arranged sides 257 of the base portion 256 press outward against the adjacent raised surfaces 247 of at least some of the grip members 246 to further secure the grounding element 234 within the jumper sleeve 232. The elongate body portions of the prongs 250 extend outward from the base portion 256 and beyond the forward edge 240 of the wrench portion 236 to position the end portions 254 outside of the wrench portion 236.

Figure 5B:
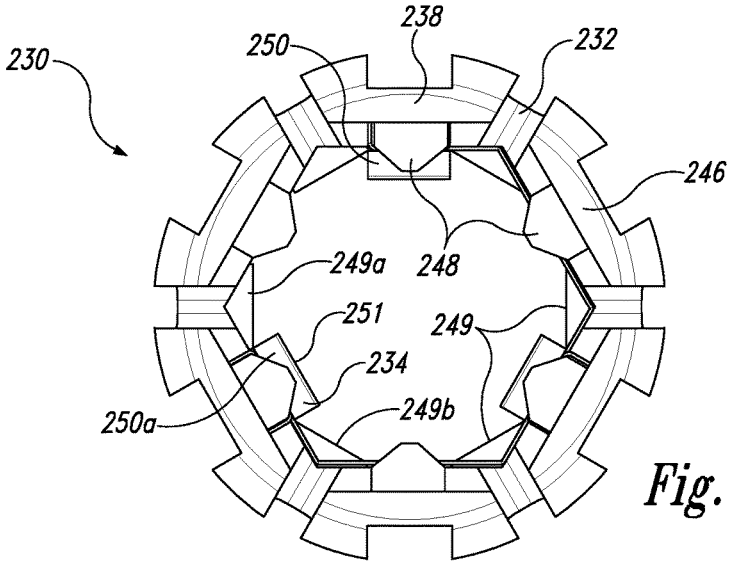
FIG. 5B is an end view of the of the connecting device of FIG. 2.

FIG. 5B is a rear end view of the connecting device 230 showing the grounding element 234 installed in the jumper sleeve 232. Each prong 250 can extend between a pair of adjacent shoulder portions 249. For example, in the illustrated embodiment, a first prong 250*a* extends between adjacent shoulder portions 249*a* and 249*b*. Thus, the shoulder portions 249 retain the male F-connector 102 within the jumper sleeve 232 without inhibiting the prongs 250 from extending outwardly of the jumper sleeve 232. Moreover, in the illustrated embodiment, the prongs 250 are equally spaced angularly around the central axis 235 of the jumper sleeve 232. Such a configuration can maximize the likelihood that ground continuity will be maintained between the connectors 102, 120 once they are connected using the connecting device 230, since any radial misalignment between the connectors 102, 120 will necessarily be towards at least one of the prongs 250. However, in some embodiments, the prongs 250 can have a different configuration (e.g., six prongs 250 each positioned adjacent a corresponding grip member 246, only one prong 250 positioned adjacent a single corresponding grip member 246, etc.).

Figure 6A:
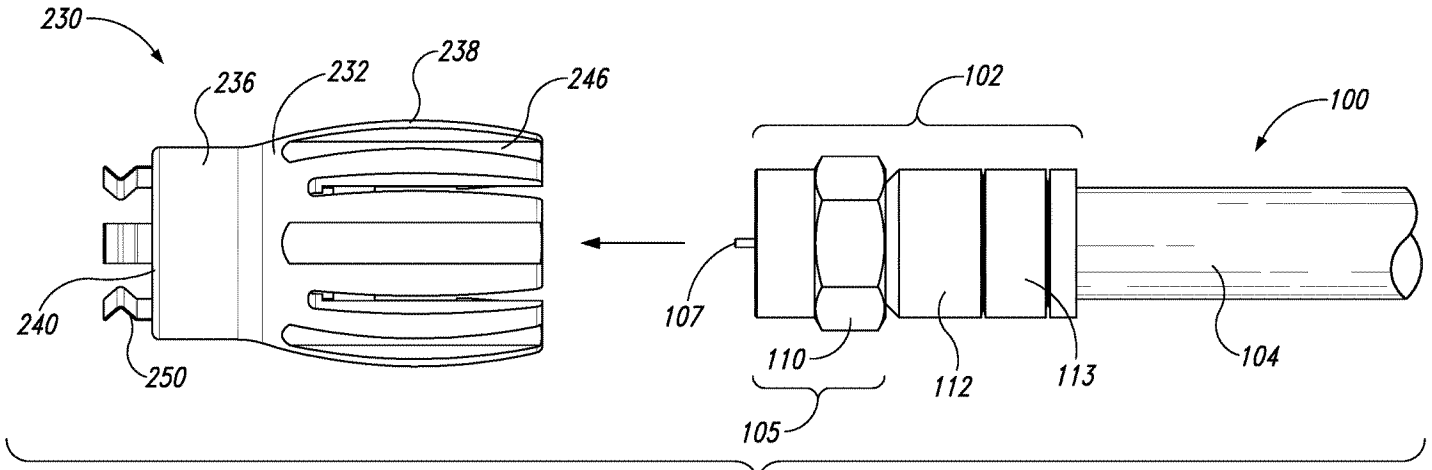
FIG. 6A is a side view of the connecting device of FIG. 2 and the coaxial cable assembly of FIG. 1A prior to installation of the connecting device.
Figure 6B:
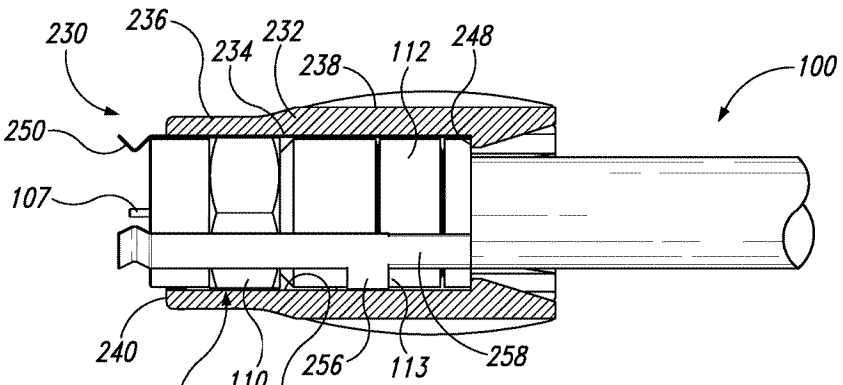
FIG. 6B is a partial cross-sectional side view of the connecting device and the coaxial cable assembly after installation of the connecting device in accordance with an embodiment of the present technology.

FIG. 6A is a side view of the coaxial cable assembly 100 and connecting device 230 prior to installation of the connecting device 230 onto the cable assembly 100. FIG. 6B is a side view of the coaxial cable assembly 100 and the connecting device 230 after installation of the connecting device 230. In FIG. 6B, the jumper sleeve 232 is shown in cross-section for clarity of illustration. Referring to FIGS. 6A and 6B together, during installation, the male F-connector 102 is fully inserted into the connecting device 230 so that the shaped inner surface 242 of the wrench portion 236 receives the hexagonal surface 110 of the connecting ring 105. The grip members 246 of the grip portion 238 can be flexed outward to allow the male F-connector 102 to be positioned within the connecting device 230. When the male F-connector 102 is fully inserted, the key portions 248 and the shoulder portions 249 (FIG. 5B) retain the male F-connector 102 in the connecting device 230.

As best seen in FIG. 6B, the grounding element 234 is positioned between the jumper sleeve 232 and the sleeve 112 and the connecting ring 105 of the male F-connector 102. In some embodiments, the base portion 256 and/or the engagement features 258 conductively engage and/or contact the outer surface 113 of the sleeve 112. Each prong 250 of the grounding element 234 conductively engages and/or contacts a corresponding one of the "flats" of the hexagonal surface 110 of the connecting ring 105 and the outer surface 113 of the sleeve 112 to maintain a metal-to-metal ground path throughout the male F-connector 102. Additionally, in this embodiment, each of the prongs 250 extends further outward beyond the forward edge 240 of the wrench portion 236 than the central conductor 107 of the coaxial cable 104.

Figure 7A:
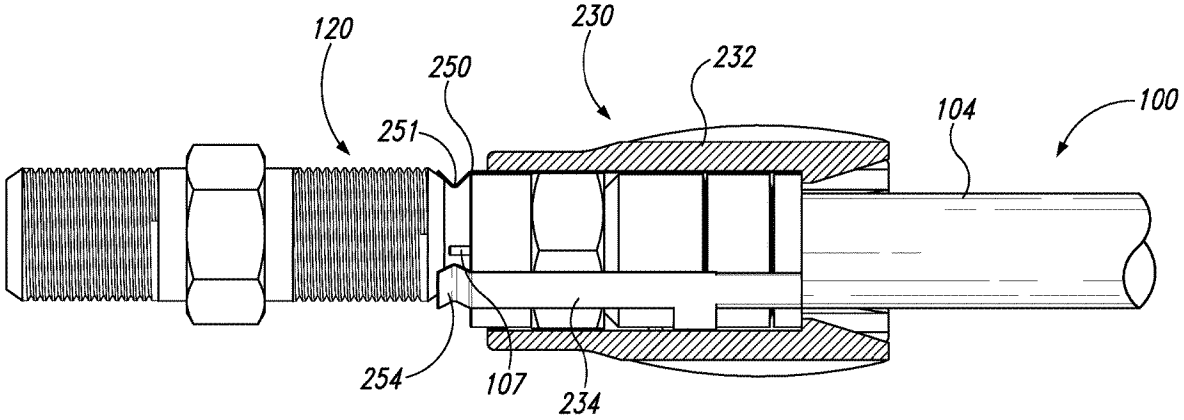
FIG. 7A is a partial cross-sectional side view of the coaxial cable assembly of FIG. 6B during connection to the female connector of FIG. 1B.
Figure 7B:
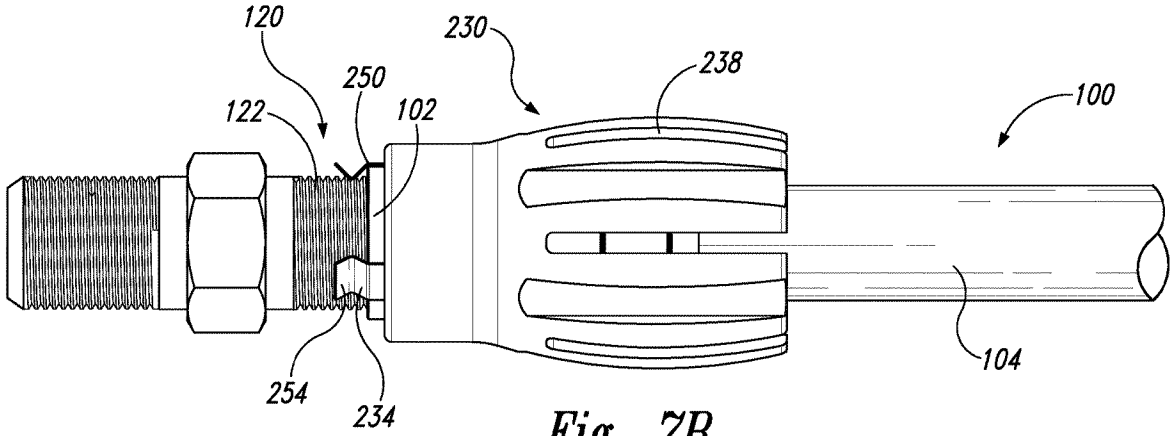
FIG. 7B is a side view of the coaxial cable assembly after connection to the female connector of FIG. 1B in accordance with an embodiment of the present technology.

FIG. 7A is a partial cross-sectional side view of the coaxial cable assembly 100 during connection to the female F-connector 120 with the connecting device 230 configured in accordance with an embodiment of the present technology. In FIG. 7A, the jumper sleeve 232 is shown in cross-section for clarity of illustration. FIG. 7B is a side view of the coaxial cable assembly 100 mated to the female F-connector 120 after installation. Referring to FIGS. 7A and 7B together, the male F-connector 102 can be connected to the female F-connector 120 in a generally similar manner as described above with reference to FIG. 1C. However, the grip portion 238 provides a larger outer diameter—and a correspondingly larger surface area—that offers a mechanical advantage compared to the hexagonal surface 110 for manipulating the connecting device 230 to apply increased torque to the rotatable connecting ring 105 of the male F-connector 102 during installation. Thus, the connecting device 230 facilitates a more efficient and secure connection of the male F-connector 102 to the female F-connector 120 than might otherwise be achievable without the connecting device 230.

In the illustrated embodiment, the prongs 250 of the grounding element 234 extend outward beyond the rotatable connecting ring 105 of the male F-connector 102 to conductively contact the female F-connector 120. More specifically, the end portions 254 project outward and radially inward toward the female F-connector 120 and contact the threaded outer surface 122 to maintain a metal-to-metal ground path between the connectors 102, 120. In some embodiments, the apexes 251 of the end portions 254 are received in the grooves of the threaded outer surface 122. In some embodiments, the prongs 250 can be formed with an inward spring bias such that, when the connectors 102, 120 are not attached, a maximum diameter (or other maximum cross-sectional dimension) between the end portions 254 is less than the diameter of the outer surface 122 of the female F-connector 120. As a result, after attachment, the prongs 250 can exert a radially inward spring force against the threaded outer surface 122 to ensure the prongs 250 remain in contact against the female F-connector 120 and to maintain the metal-to-metal ground connection between the connectors 102, 120.

Accordingly, the connecting device 230 of the present technology can maintain ground continuity between the connectors 102, 120 when the connection between the connectors 102, 120 may be less than secure. For example, the prongs 250 of the grounding element 234 conductively contact the female F-connector even when the connection—and therefore the ground path—between the threaded surfaces 108, 122 of the connectors 102, 120, respectively, is less than secure. Moreover, as shown in FIG. 7A, because the prongs 250 extend outwardly beyond the male F-connector 102, the prongs 250 can contact the female F-connector 120 before any portion of the male F-connector 102 contacts the female F-connector 120 during installation. In particular, at least one of the prongs 250 can conductively contact the female F-connector 120 before the central conductor 107 of the coaxial cable 104 contacts the female F-connector 120. Thus, the grounding element 234 can provide a ground path that discharges any built-up capacitive charge in the central conductor 107 before the capacitive charge can be discharged into, for example, the host electrical device coupled to the female F-connector 120.

Figure 8:
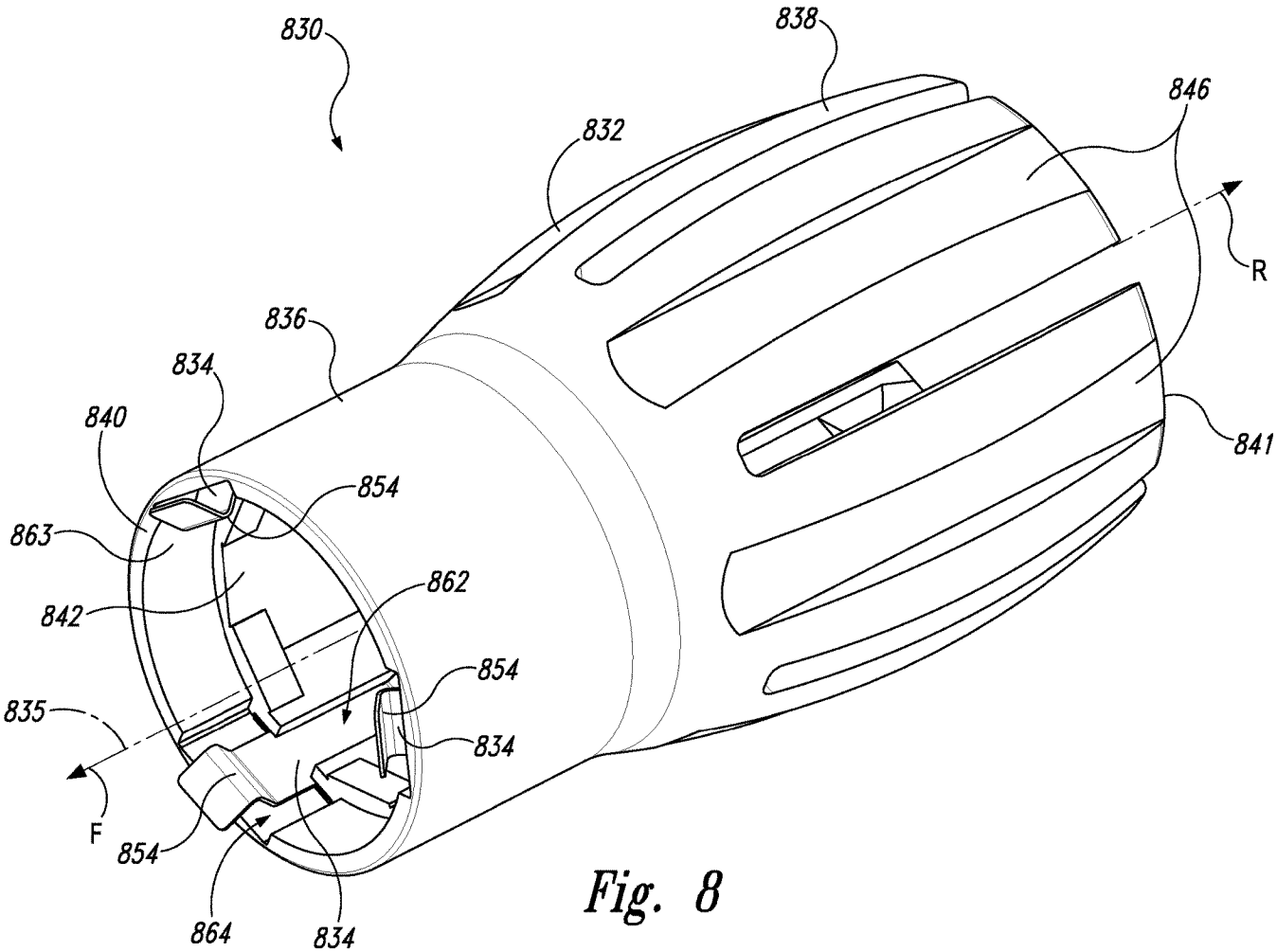
FIG. 8 is a front isometric view of a connecting device configured in accordance with another embodiment of the present technology.

FIG. 8 is an isometric view of a connecting device 830 configured in accordance with another embodiment of the present technology. The connecting device 830 can include some features generally similar to the features of the connecting device 230 described in detail above with reference to FIGS. 2-7B. For example, in the illustrated embodiment, the connecting device 830 includes a hollow gripping member, referred to herein as a jumper sleeve 832, having a central axis 835 and configured to facilitate connection between two coaxial cable connectors. The jumper sleeve 832 includes a wrench portion 836 and a grip portion 838. The wrench portion 836 has a forward edge 840, a first inner surface 842, and a second inner surface 863. The first inner surface 842 is configured (e.g., shaped) to receive and at least partially grip an outer surface of a coaxial cable connector. For example, in the illustrated embodiment, the first inner surface 842 has a complimentary hexagonal shape for snugly receiving the hexagonal surface 110 of the connecting ring 105 shown in FIG. 1A. In other embodiments, the first inner surface 842 can have other shapes and features to facilitate receiving and/or gripping coaxial cable connectors having different shapes. As described in further detail below, the grip portion 838 extends from the wrench portion 836 toward a rear edge 841, and can have one or more grip members 846. The grip members 846 extend axially away from the wrench portion in a direction R, and can provide a gripping surface for applying torque to the rotatable connecting ring 105 of the male F-connector 102 received in the wrench portion 836.

As further illustrated in FIG. 8, the jumper sleeve 832 includes a plurality of (e.g., three) first recesses (e.g., grooves, channels, slots, etc.) 862 extending generally parallel to the central axis 835 and at least partially through (e.g., formed in, defined by, etc.) the first inner surface 842. The jumper sleeve 832 further includes a plurality of second recesses (e.g., grooves, channels, slots, etc.) 864 extending at least partially through (e.g., formed in, defined by, etc.) the second inner surface 863. As shown in the embodiment of FIG. 8, the first recesses 862 can be aligned with corresponding ones of the second recesses 864 and can be equally spaced around the central axis 835. Moreover, in some embodiments, the second recesses 864 can extend farther circumferentially about the central axis 835 than the first recesses 862.

The connecting device 830 also includes one or more (e.g., three) grounding elements 834 that can be removably or permanently installed at least partially within the jumper sleeve 832. The grounding elements 834 are made from a conductive material (e.g., a conductive resilient material such as copper beryllium) and each have an elongate body that extends outward in a direction F at least partially beyond the first inner surface 842 of the wrench portion 836. In some embodiments, each of the grounding elements 834 can also include an end portion 854 that extends outwardly at least partially beyond the forward edge 840 of the jumper sleeve 832. In other embodiments, the connecting device 830 can include a different number of grounding elements 834 (e.g., one grounding element, two grounding elements, four grounding elements, six grounding elements, etc.).

Each grounding element 834 is received and/or secured at least partially within corresponding pairs of the recesses 862, 864. In particular, the elongate body of each grounding element 834 can extend generally parallel to the central axis 835 of the jumper sleeve 832, and the end portion 854 (e.g., an engagement portion) can extend beyond the first inner surface 842 and radially inward toward the central axis 835. When the connecting device 830 is used to connect the male F-connector 102 to the female F-connector 120, as described below, at least a portion of each grounding element 834 conductively contacts at least a portion of the male F-connector 102, and the grounding elements 834 conductively contact at least a portion of the female F-connector 120 to maintain ground path continuity between the two connectors 102, 120.

Figure 9A:
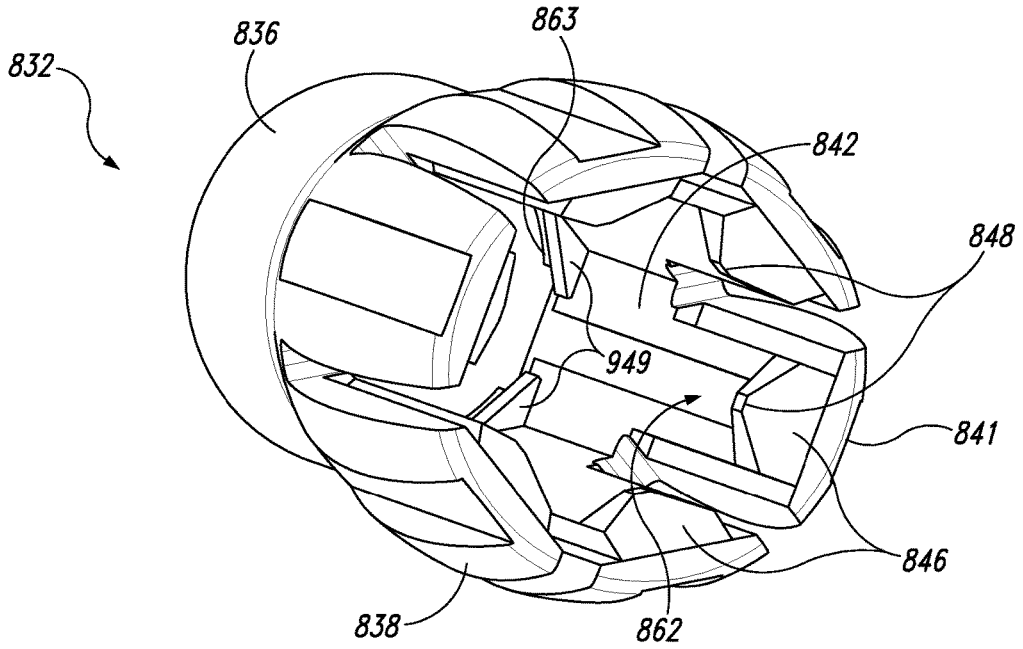
FIGS. 9A-9C are rear, front, and enlarged front isometric views, respectively, of a jumper sleeve of the connecting device of FIG. 8 configured in accordance with an embodiment of the present technology.
Figure 9B:
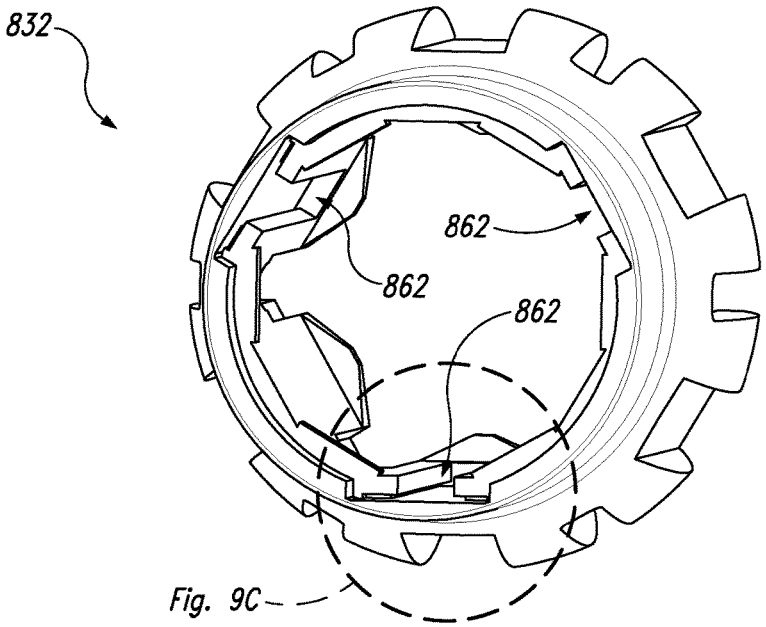

FIGS. 9A and 9B are rear and front isometric views, respectively, of the jumper sleeve 832 prior to installation of the grounding elements 834. The jumper sleeve 832 can include some features generally similar to the features of the jumper sleeve 232 described in detail above with reference to FIG. 3. For example, referring to FIG. 9A, in the illustrated embodiment the grip portion 238 has a cask-shape with a plurality of (e.g., six) convex grip members 846 extending outwardly from the wrench portion 836. For example, the grip members 846 can be cantilevered from the wrench portion 836. In other embodiments, the grip portion 838 can include one or more grip members 846 having different shapes (e.g., concave, angular, etc.), and/or fewer or more than the six grip members 846 shown in FIG. 9A. In some embodiments, individual grip members 846 can be omitted, and instead the grip portion 838 can include a single (e.g., cylindrical, conical, etc.) member. When the male F-connector 102 (FIG. 1A) is inserted into the jumper sleeve 832, the grip members 846 allow for application of a greater torque to the rotatable connecting ring 105 than could otherwise be achieved by direct manual rotation of the hexagonal surface 110 of the male F-connector 102.

In the embodiment illustrated in FIG. 9A, the grip members 846 each include a key portion 848 projecting inward toward the central axis 835 (FIG. 8). In some embodiments, the key portions 848 are positioned proximate the rear edge 841 of the grip member 838. The key portions 848 are configured to abut a portion of the male F-connector 102 (e.g., a rear edge of the sleeve 112) to retain the male F-connector 102 in the jumper sleeve 832 and to inhibit the male F-connector 102 from moving out of the jumper sleeve 832 in the direction R (FIG. 8). Similarly, one or more shoulder portions 949 can bridge between adjacent "flats" of the first (e.g., hexagonal) inner surface 842 proximate to the second inner surface 863, and are configured to abut a forward edge of the hexagonal surface 110 (e.g., a shoulder between the first outer surface portion 106 and the hexagonal surface 110) of the connecting ring 105 to inhibit the male F-connector 102 from moving out of the jumper sleeve 832 in the direction F (FIG. 8).

As further illustrated in the embodiment of FIG. 9A, the first recesses 862 can extend from the first inner surface 842 of the wrench portion 836 and at least partially along corresponding ones of the grip members 846 toward the rear edge 841 of the grip portion 838. In some embodiments, as illustrated in FIG. 9B, the jumper sleeve 832 can include three first recesses 862 (e.g., a number corresponding to the number of grounding elements 834), and the first recesses 862 can generally extend along alternating ones of the six grip members 846. In other embodiments, the first recesses 862 can have other configurations (e.g., spacing, relative length, number, etc.) and/or shapes other than rectangular (e.g., sinusoidal, oval, etc.). As described in further detail below, the first recesses 862 are configured (e.g., rectangularly shaped and sized) to receive and retain the grounding elements 834 therein.

Figure 9C:
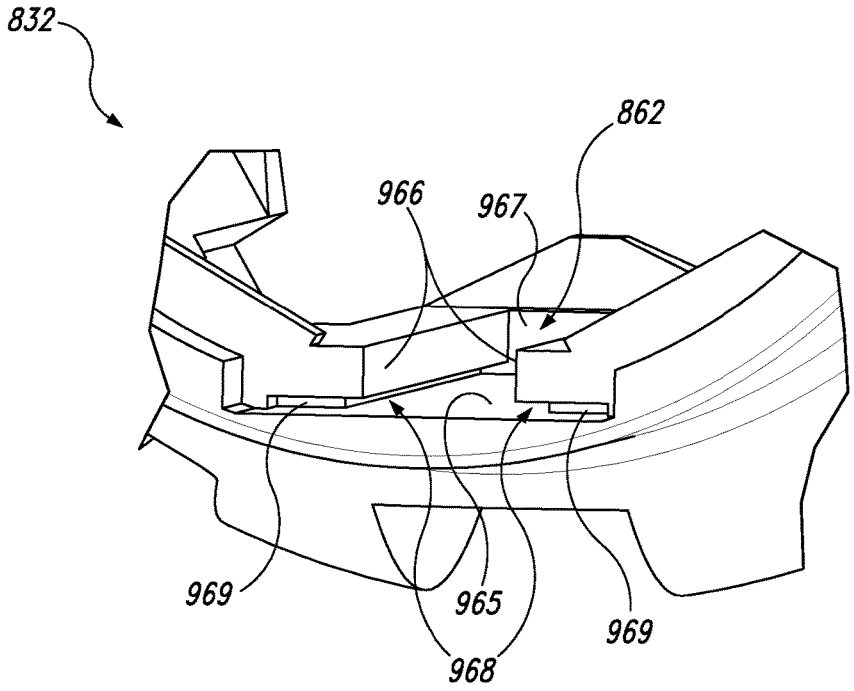

For example, FIG. 9C is an enlarged, front isometric view of the jumper sleeve 832 showing one of the first recesses 862. In the illustrated embodiment, the first recess 862 can be defined by (i) opposing securing features (e.g., sidewalls, lips, overhang portions, etc.) 966, (ii) opposing outer shoulder portions 969, (iii) an inner surface 965, and/or (iii) an end wall 967. The securing features 966 can project toward each other beyond the outer shoulder portions 969 to define overhang regions 968 between the securing features 966 and the inner surface 965. That is, a distance (e.g., width) between the securing features 966 can be less than a distance (e.g., width) between the outer shoulder portions 969. In some embodiments, the jumper sleeve 832 can be made from, for example, plastic, rubber, metal, and/or other suitable materials using methods well known in the art.

Figure 10:
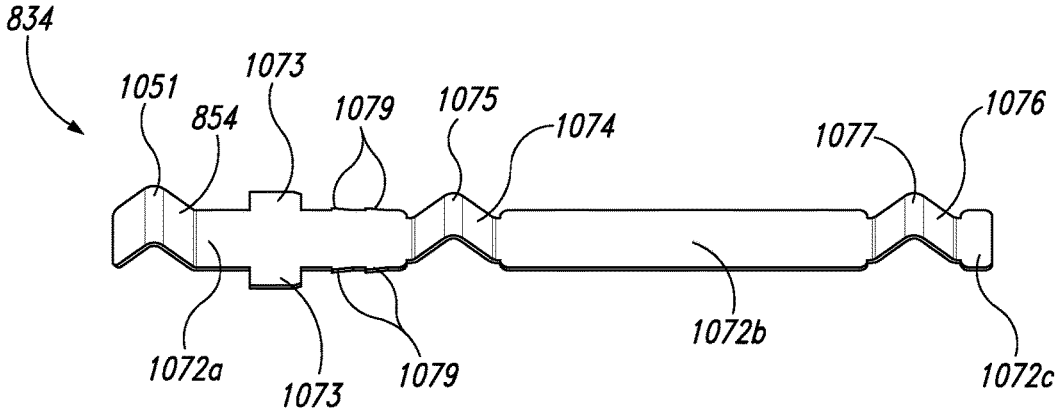
FIG. 10 is a side isometric view of a grounding element of the connecting device of FIG. 9 configured in accordance with an embodiment of the present technology.

FIG. 10 is an isometric view of one of the grounding elements 834 configured in accordance with an embodiment of the present technology. While only one grounding element 834 is shown in FIG. 10, as noted above, the connecting device 830 can include one or more grounding elements 834. In some embodiments, the individual grounding elements 834 can be generally similar (e.g., identical) while, in other embodiments, the individual grounding elements 834 can have different configurations. In further embodiments, two or more of the grounding elements 834 can be connected together via a base or other portion or they can be separate as shown in FIG. 10.

In the illustrated embodiment, the grounding element 834 includes (i) the end portion 854, (ii) body portions 1072 (referred to individually as first, second, and third body portions 1072*a*, 1072*b*, and 1072*c*, respectively), (iii) a first contact feature 1074 extending between the first and second body portions 1072*a*, 1072*b*, and (iv) a second contact feature 1076 extending between the second and third body portions 1072*b*, 1072*c*. As described in further detail below, the body portions 1072 are configured to be snugly (e.g., closely) fitted and/or slidably received at least partially within one of the first recesses 862 of the jumper sleeve 832 and, in some embodiments, the first body portion 1072*a* can include one or more projections or flanges 1073 and/or teeth 1079 configured to help retain and/or secure the grounding element 834 within the first recess 862 of the jumper 832.

Each of the end portion 854, the first contact feature 1074, and the second contact feature 1076 are shaped (e.g., bent or otherwise formed) to extend inwardly relative to axis 835 (FIG. 8). In some embodiments, the end portion 854 can have an angled or chevron-like profile including a rounded apex 1051 that is configured to contact or engage the threaded outer surface 122 of the female F-connector 120 (FIG. 1B). Similarly, the first contact feature 1074 can have an angled or chevron-like shape including an apex 1075 that is configured to contact or engage a portion of (e.g., the hexagonal surface 110) of the rotatable connecting ring 105 of the male F-connector 102 (FIG. 1A). The second contact feature 1076 can also have an angled or chevron-like shape including an apex 1077 that is configured to contact or engage the outer surface 113 of the sleeve 112 of the rotatable connecting ring 105 of the male F-connector 102 (FIG. 1A).

In some embodiments, the grounding elements 834 can be formed from any suitable conductive material (e.g., a metallic material) such as, for example, copper beryllium, brass, phosphor bronze, stainless steel, etc., and can have any suitable thickness. For example, in some embodiments, the grounding elements 834 can have a thickness of from about 0.001 inch to about 0.032 inch, or about 0.003 inch to about 0.020 inch. In some embodiments, the grounding elements 834 can be formed from a resilient conductive material that is suitably elastic to flex in response to external forces experienced in use.

Figure 11A:
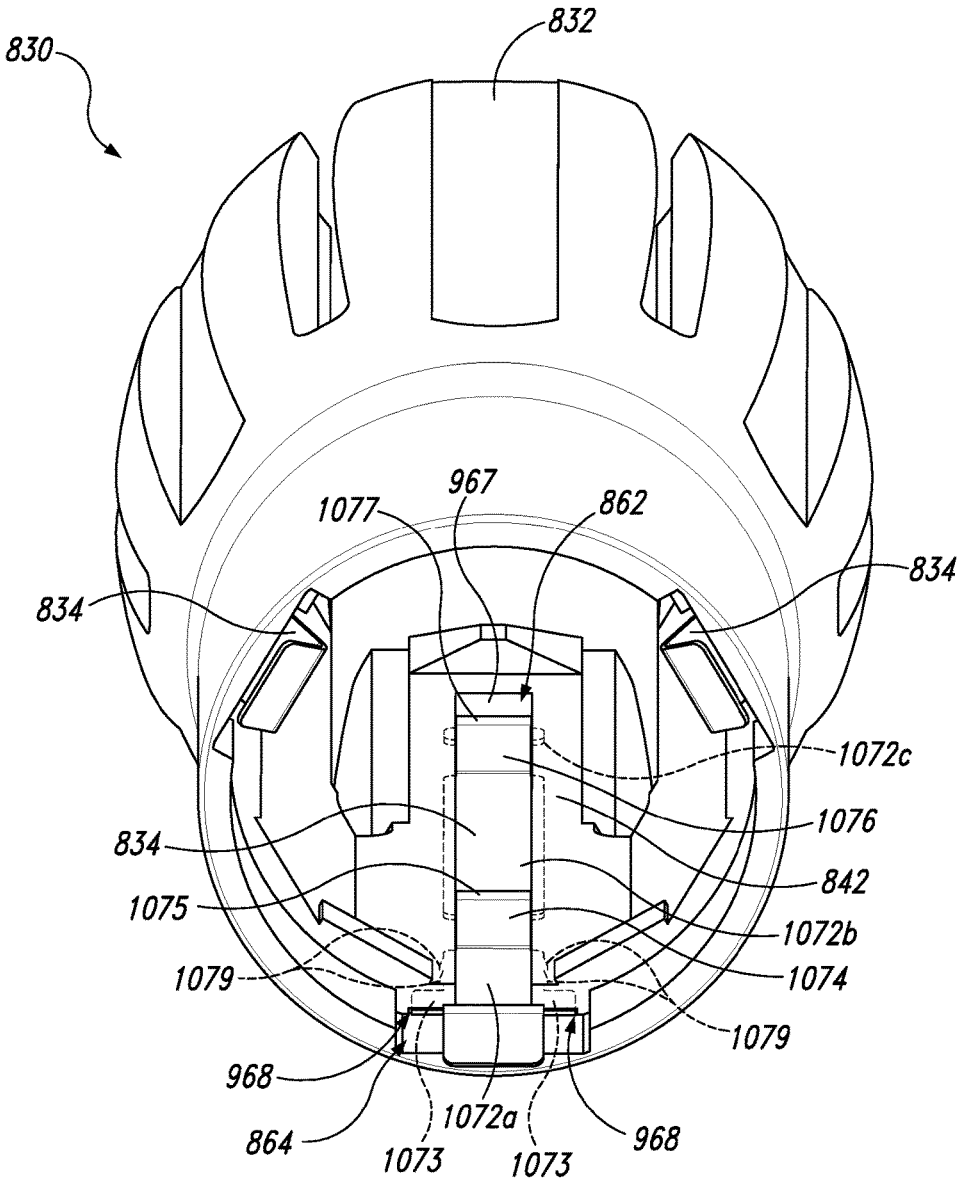
FIG. 11A is a partially transparent front isometric view.
Figure 11B:
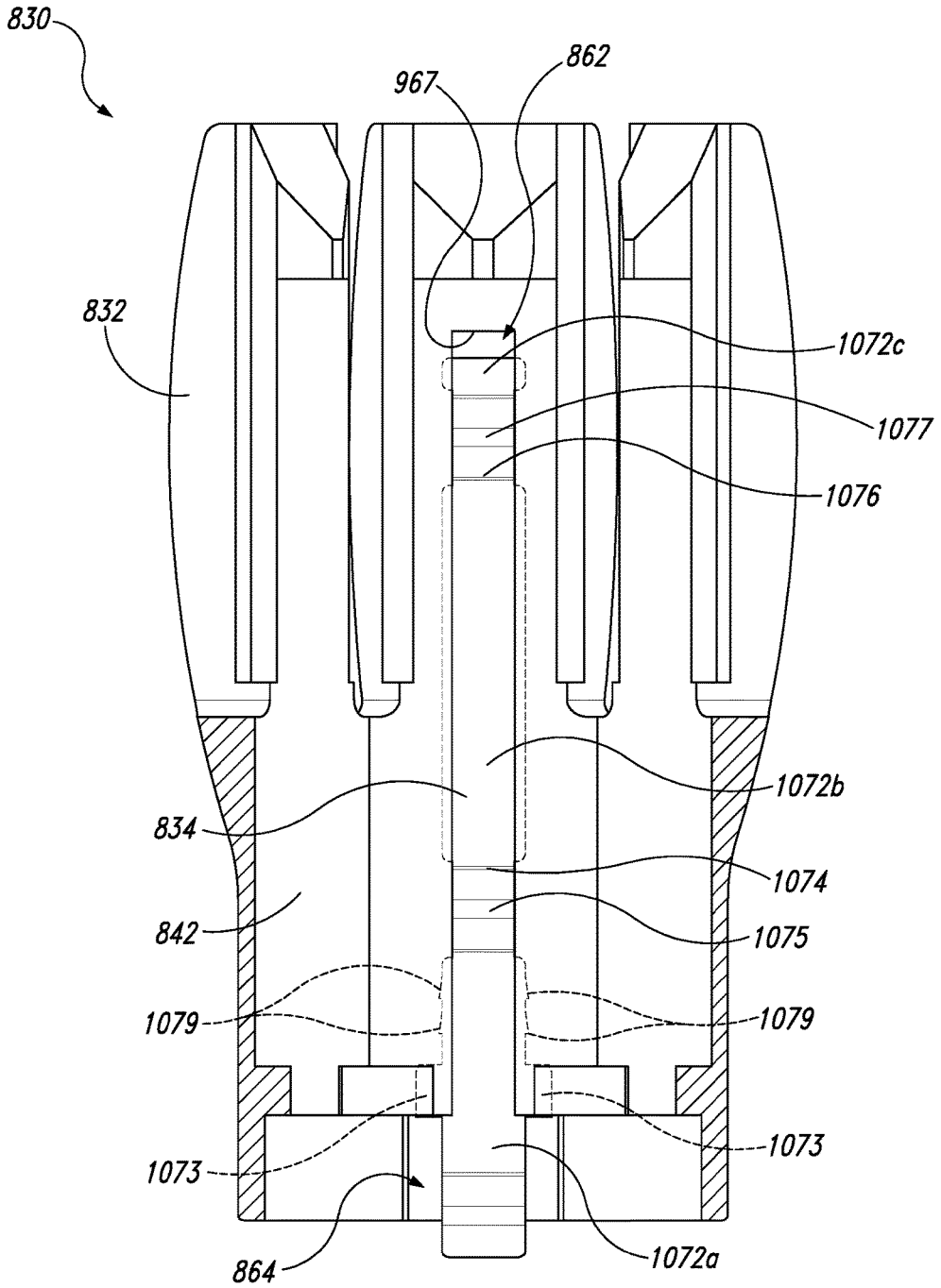
FIG. 11B is a partially transparent top cross-sectional view of the connecting device of FIG. 9.

FIG. 11A is a front isometric view, and FIG. 11B is a top cross-sectional view, of the connecting device 830 showing the grounding element 834 installed within the jumper sleeve 832. In FIGS. 11A and 11B, the jumper sleeve 832 is shown as partially transparent for clarity of illustration. Referring to FIGS. 11A and 11B together, in the illustrated embodiment, each of the grounding elements 834 is installed within corresponding pairs of the recesses 862, 864. For example, in some embodiments, the third body portion 1072*c* of each of the grounding elements 834 can be aligned with one of the second recesses 864, and then moved axially (e.g., pushed) in the direction R (FIG. 8) through the second recess 864 and into a corresponding one of the first recesses 862. The grounding elements 834 can be moved axially in the direction R until the flanges 1073 abut the outer shoulder portions 969 (best seen in FIG. 9B) of the jumper sleeve 832 and/or the third body portions 1072*c* abut the end walls 967 of the jumper sleeve 832, which inhibits the grounding elements 834 from moving farther in the direction R and facilitates suitable positioning of the grounding elements 834 within the jumper sleeve 832 (e.g., relative to the later installed male F-connector 102). In certain embodiments, the third body portion 1072*c* of each grounding element 834 is spaced apart from the end wall 967 prior to installation of the male F-connector 102. As further illustrated in the embodiment of FIGS. 11A and 11B, the body portions 1072 of the grounding elements 834 can extend at least partially into the overhang regions 968 of the jumper sleeve 832 to inhibit the grounding elements 834 from moving radially inward toward the central axis 835 (FIG. 8).

Likewise, in some embodiments, the teeth 1079 of the grounding 834 are shaped to inhibit movement of the grounding elements 834 in the direction F (FIG. 8) once the teeth 1079 are positioned within the first recess 862. For example, in certain embodiments, the teeth 1079 can engage (e.g., "bite into") the outer shoulder portions 969 when the grounding elements 834 are moved (e.g., pulled) in the direction F (FIG. 8). Accordingly, in some embodiments, the grounding elements 834 are permanently or semi-permanently installed within the jumper sleeve 832. In other embodiments, the grounding elements 834 can be releasably secured within the jumper sleeve 832 (e.g., the grounding elements 834 need not include the teeth 1079 or other similar features). In yet other embodiments, the grounding elements 834 can be secured within the jumper sleeve 832 via other means. For example, the grounding elements 834 can be cast into, adhesively bonded, welded, fastened, and/or otherwise integrated or attached to the jumper sleeve 832 during or after manufacture.

In the illustrated embodiment, the grounding elements 834 are equally spaced angularly around the central axis 835 (FIG. 8) of the jumper sleeve 832. Such a configuration can maximize the likelihood that ground continuity will be maintained between the connectors 102, 120 once they are connected using the connecting device 830, since any radial misalignment between the connectors 102, 120 will necessarily be towards at least one of the grounding elements 834. However, in some embodiments, the grounding elements 834 can have a different configuration (e.g., six grounding elements 834 each positioned within a corresponding first recess 862 extending along one of the six grip members 846, only a single grounding element 834 positioned within a first recess 862 extending along one of the six grip members 846, etc.).

In some embodiments, after installation into the jumper sleeve 832, the first and second contact features 1074, 1076 (collectively "contact features 1074, 1076") can project inwardly from the first recesses 862 (e.g., extend inward beyond the first inner surface 842) such that the apex 1075 of the first contact feature 1074 and the apex 1077 of the second contact feature 1076 are positioned to conductively contact the male F-connector 102 (FIG. 1A) when it is installed within the jumper sleeve 832. In certain embodiments, where the grounding elements 834 are made of a resilient conductive material, the contact features 1074, 1076 can flex outward when the male F-connector 102 is installed within the jumper sleeve 832. In some such embodiments, the contact features 1074, 1076 can correspondingly lengthen (e.g., flatten out in a direction parallel to the central axis 835) and/or the apexes 1075, 1077 can be forced outwardly until they are at least partially or generally coplanar with the first inner surface 842.

Figure 12A:
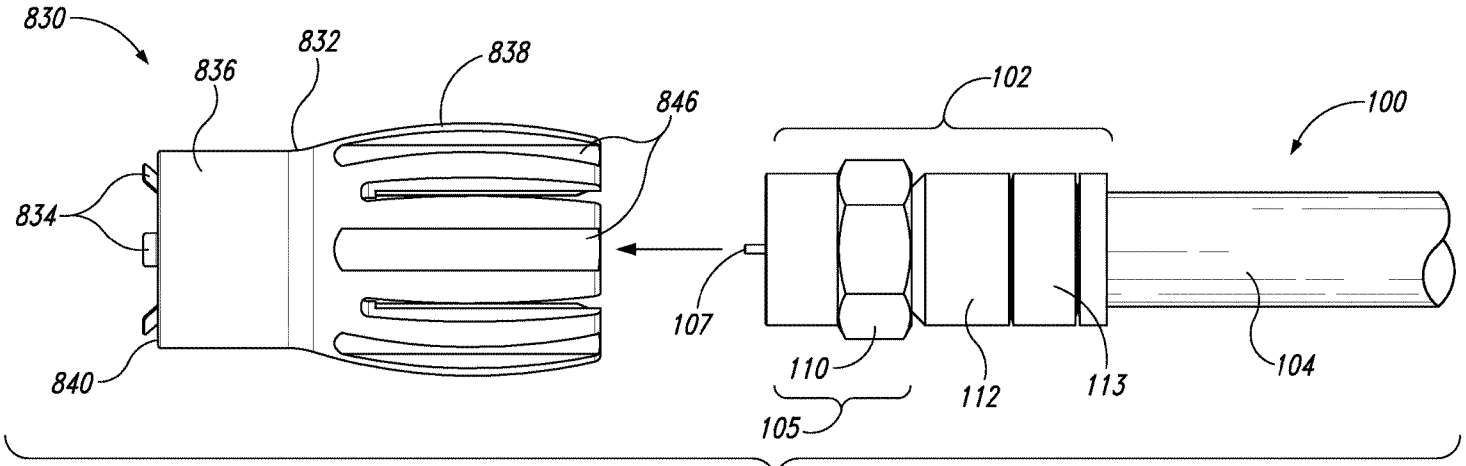
FIG. 12A is a side view of the connecting device of FIG. 8 and the coaxial cable assembly of FIG. 1A prior to installation of the connecting device on the cable assembly.
Figure 12B:
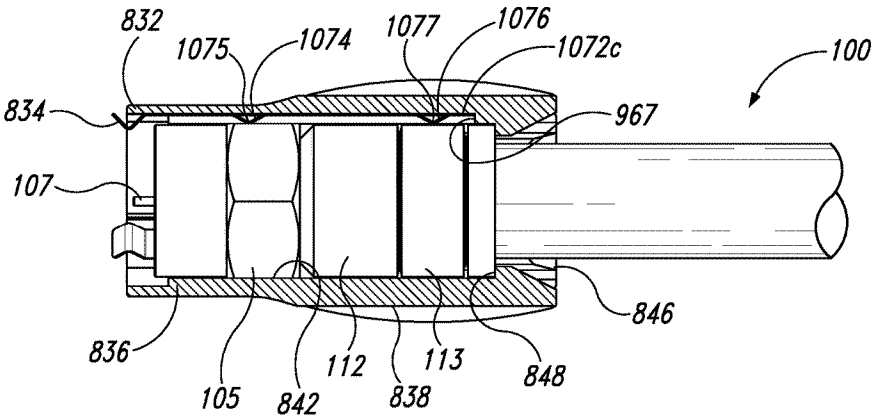
FIG. 12B is a partial cross-sectional side view of the connecting device and the coaxial cable assembly after installation of the connecting device in accordance with an embodiment of the present technology.

FIG. 12A is a side view of the coaxial cable assembly 100 and connecting device 830 prior to installation of the connecting device 830 onto the coaxial cable assembly 100. FIG. 12B is a side view of the coaxial cable assembly 100 and the connecting device 830 after installation of the connecting device 830. In FIG. 12B, the connecting device 830 is shown in cross-section for clarity of illustration. Referring to FIGS. 12A and 12B together, during installation, the male F-connector 102 is fully inserted into the connecting device 830 so that the first inner surface 842 of the wrench portion 836 receives the hexagonal surface 110 of the connecting ring 105. In some embodiments, the grip members 846 of the grip portion 838 can be flexed outward to allow the male F-connector 102 to be positioned within the connecting device 830. When the male F-connector 102 is fully inserted, the key portions 848 and the shoulder portions 949 (obscured in FIG. 12B; illustrated in FIG. 9A) retain the male F-connector 102 in the connecting device 830.

As best seen in FIG. 12B, the grounding elements 834 are positioned between the jumper sleeve 832 and the sleeve 112 and the connecting ring 105 of the male F-connector 102. More particularly, in some embodiments, the apex 1075 of the first contact feature 1074 of each grounding element 834 conductively engages (e.g., contacts) a corresponding one of the "flats" of the hexagonal surface 110 of the connecting ring 105 while the apex 1077 of the second contact feature 1076 conductively engages (e.g., contacts) the outer surface 113 of the sleeve 112. Accordingly, each grounding element 834 is configured to maintain a metal-to-metal ground path throughout the male F-connector 102.

As described above, in some embodiments, the contact features 1074, 1076 can be forced to flex radially outwardly when the male F-connector 102 is installed within the jumper sleeve 832. In such embodiments, the contact features 1074, 1076 can exert a biasing force against the male F-connector 102 to provide a secure engagement (e.g., contact) between the grounding elements 834 and the male F-connector 102. In some such embodiments, the contact features 1074, 1076 can correspondingly lengthen (e.g., flatten out) slightly such that the grounding elements 834 have an increased overall length. In the illustrated embodiment, the connecting device 830 is configured such that the third body portions 1072*c* of the grounding elements 834 are positioned proximate to (e.g., abut against) the end walls 967 after the male-F connector 102 is installed. Additionally, in the illustrated embodiment, each of the grounding elements 834 extends beyond the forward edge 840 of the wrench portion 836, while the central conductor 107 of the coaxial cable 104 does not extend beyond the forward edge 840 of the wrench portion 836.

Figure 13A:
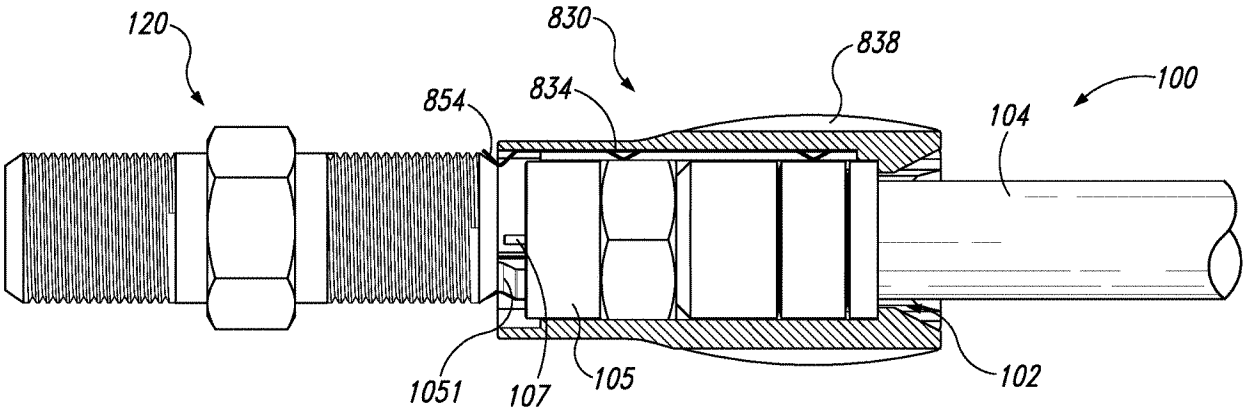
FIG. 13A is a partial cross-sectional side view of the coaxial cable assembly of FIG. 12B during connection to the female connector of FIG. 1B.
Figure 13B:
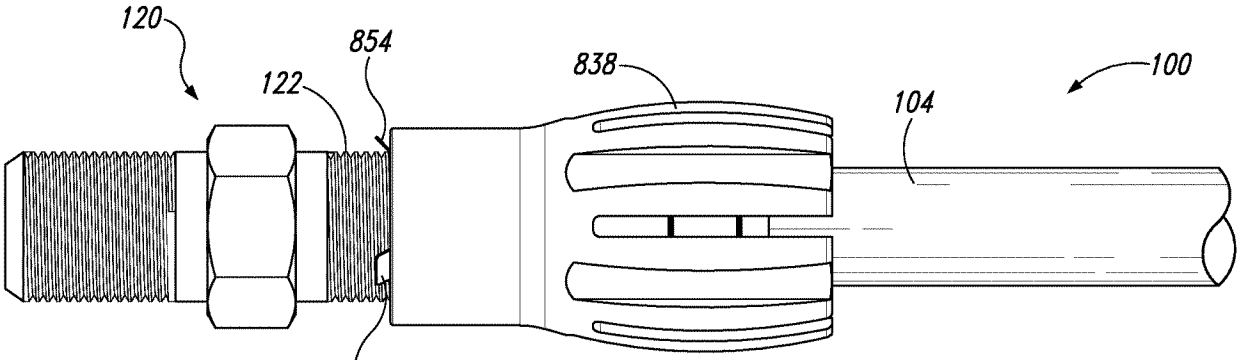
FIG. 13B is a side view of the coaxial cable assembly after connection to the female connector of FIG. 1B in accordance with an embodiment of the present technology.

FIG. 13A is a partial cross-sectional side view of the coaxial cable assembly 100 during connection to the female F-connector 120 with the connecting device 830 configured in accordance with an embodiment of the present technology. In FIG. 13A, the connecting device 830 is shown in cross-section for clarity of illustration. FIG. 13B is a side view of the coaxial cable assembly 100 mated to the female F-connector 120 after installation. Referring to FIGS. 13A and 13B together, the male F-connector 102 can be connected to the female F-connector 120 in a generally similar manner as described above with reference to FIG. 1C. However, the grip portion 838 provides a larger outer diameter—and a correspondingly larger surface area—that offers a mechanical advantage compared to the hexagonal surface 110 for manipulating the connecting device 830 to apply increased torque to the rotatable connecting ring 105 of the male F-connector 102 during installation. Thus, the connecting device 830 facilitates a more efficient and secure connection of the male F-connector 102 to the female F-connector 120 than might otherwise be achievable without the connecting device 830.

In the illustrated embodiment, the grounding elements 834 extend outward beyond the rotatable connecting ring 105 of the male F-connector 102 to conductively contact the female F-connector 120. More specifically, the end portions 854 project outward and radially inward toward the female F-connector 120 and contact the threaded outer surface 122 of the female F-connector 120 to maintain a metal-to-metal ground path between the connectors 102, 120. In some embodiments, the apexes 1051 of the end portions 854 are received in the grooves of the threaded outer surface 122. In some embodiments, all or a portion (e.g., the end portions 854, the first body portions 1072*a*, etc.) of the grounding elements 834 can be formed with an inward spring bias such that, when the connectors 102, 120 are not attached, a maximum diameter (or other maximum cross-sectional dimension) between the end portions 854 is less than the diameter of the outer surface 122 of the female F-connector 120. As a result, after attachment, the grounding elements 834 can exert a radially inward spring force against the threaded outer surface 122 to ensure that the grounding elements 834 remain in contact against the female F-connector 120 and to maintain the metal-to-metal ground connection between the connectors 102, 120.

Accordingly, the connecting device 830 of the present technology can maintain ground continuity between the connectors 102, 120 when the connection between the connectors 102, 120 may be less than secure. For example, the grounding elements 834 conductively contact the female F-connector 120 even when the connection—and therefore the ground path—between the threaded surfaces 108, 122 of the connectors 102, 120, respectively, is less than secure. Moreover, as shown in FIG. 13A, because the grounding elements 834 extend outwardly beyond the male F-connector 102, the grounding elements 834 can contact the female F-connector 120 before any portion of the male F-connector 102 contacts the female F-connector 120 during installation. In particular, at least one of the grounding elements 834 can conductively contact the female F-connector 120 before the central conductor 107 of the coaxial cable 104 contacts the female F-connector 120. Thus, the grounding element 834 can provide a ground path that discharges any built-up capacitive charge in the central conductor 107 before the capacitive charge can be discharged into, for example, the host electrical device coupled to the female F-connector 120.

The foregoing description of embodiments of the technology is not intended to be exhaustive or to limit the disclosed technology to the precise embodiments disclosed. While specific embodiments of, and examples for, the present technology are described herein for illustrative purposes, various equivalent modifications are possible within the scope of the present technology, as those of ordinary skill in the relevant art will recognize. For example, although certain functions may be described in the present disclosure in a particular order, in alternate embodiments these functions can be performed in a different order or substantially concurrently, without departing from the spirit or scope of the present disclosure. In addition, the teachings of the present disclosure can be applied to other systems, not only the representative connectors described herein. Further, various aspects of the technology described herein can be combined to provide yet other embodiments.

All of the references cited herein are incorporated in their entireties by reference. Accordingly, aspects of the present technology can be modified, if necessary or desirable, to employ the systems, functions, and concepts of the cited references to provide yet further embodiments of the disclosure. These and other changes can be made to the present technology in light of the above-detailed description. In general, the terms used in the following claims should not be construed to limit the present technology to the specific embodiments disclosed in the specification, unless the above-detailed description explicitly defines such terms. Accordingly, the actual scope of the disclosure encompasses the disclosed embodiments and all equivalent ways of practicing or implementing the disclosure under the claims.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below," and words of similar import, when used in this application, shall refer to this application as a whole and not to any particular portions of this application. When the claims use the word "or" in reference to a list of two or more items, that word covers all of the following interpretations of the word: any of the items in the list, all of the items in the list, and any combination of the items in the list.

From the foregoing, it will be appreciated that specific embodiments of the disclosed technology have been described herein for purposes of illustration, but that various modifications may be made without deviating from the present technology. Certain aspects of the disclosure described in the context of particular embodiments may be combined or eliminated in other embodiments. Further, while advantages associated with certain embodiments of the disclosed technology have been described in the context of those embodiments, other embodiments may also exhibit such advantages, and not all embodiments need necessarily exhibit such advantages to fall within the scope of the disclosed technology. Accordingly, the disclosure and associated technology can encompass other embodiments not expressly shown or described herein. The following examples are directed to embodiments of the present disclosure.

I claim:

1. A device for attaching a first coaxial cable connector to a second coaxial cable connector, the first coaxial cable connector having a threaded connecting ring rotatably coupled to a sleeve, the device comprising:

a gripping member configured to operably receive at least a portion of the first coaxial cable connector; and a grounding element at least partially disposed in the gripping member, wherein the grounding element includes first, second, and third contact features, and wherein the first contact feature is configured to conductively contact the sleeve, the second contact feature is configured to conductively contact the connecting ring, and the third contact feature is configured to extend beyond an outer edge of the connecting ring when the first coaxial cable connector is operably received by the gripping member.

2. The device of claim 1 wherein the third contact feature is configured to conductively contact the second coaxial cable connector when the connecting ring is mated to the second coaxial cable connector.

3. The device of claim 1 wherein the third contact feature at least partially extends beyond a forward edge of the gripping member.

4. The device of claim 3 wherein the third contact feature includes an apex configured to engage a threaded exterior surface of the second coaxial cable connector when the connecting ring is mated to the second coaxial cable connector.

5. The device of claim 1 wherein the grounding element is formed from a resilient conductive material.

6. The device of claim 5 wherein the grounding element is configured to exert a radially inward spring force against an outer surface of the second coaxial cable connector when the connecting ring is mated to the second coaxial cable connector.

7. The device of claim 1 wherein the first coaxial cable connector includes a central conductor projecting beyond the outer edge of the connecting ring, and wherein the third contact feature is configured to extend at least partially beyond the central conductor when the first coaxial cable connector is operably received by the gripping member.

8. The device of claim 1 wherein the grounding element is removably secured within the gripping element via an interference fit.

9. The device of claim 1 wherein the gripping member includes an inner surface having a recess formed therein;

the grounding element includes an elongated body and is at least partially secured within the recess in the gripping member;

the first contact feature is a first projection extending radially inward from the elongate body and at least partially outside of the recess; and the second contact feature is a second projection extending radially inward from the elongate body and at least partially outside of the recess.

10. The device of claim 1 wherein the first coaxial cable connector is a male F-connector and wherein the second coaxial cable is a female F-connector.

11. A connecting device, comprising:

a hollow member configured to receive a male coaxial cable connector and having a longitudinal axis extending therethrough; and at least one grounding element carried by the hollow member such that, when the hollow member receives the male coaxial cable connector, a first portion of the at least one grounding element conductively contacts a sleeve of the male coaxial cable connector and a second portion of the at least one grounding element conductively contacts a rotatable ring of the male coaxial cable and extends axially beyond a central conductor of the male coaxial cable connector.

12. The connecting device of claim 11 wherein the at least one grounding element conductively contacts an outer surface of a female coaxial cable connector when the male coaxial cable connector is mated to the female coaxial cable connector.

13. The connecting device of claim 11 wherein the connecting device includes three elongate grounding elements secured within the hollow member and equally spaced circumferentially about the longitudinal axis.

14. The connecting device of claim 13 wherein the elongate grounding elements each include an end portion positioned axially beyond the central conductor of the male coaxial cable connector, wherein the elongate grounding elements are formed of a resilient material, and wherein a maximum diameter between the end portions is less than a diameter of an outer surface of a female coaxial cable connector configured to be mated to the male coaxial cable connector.

15. The connecting device of claim 11 wherein the at least one grounding element includes a single grounding element having a base portion extending at least partially circumferentially about the longitudinal axis and at least one prong extending axially from the base portion, wherein the at least one prong is configured to conductively contact (a) the rotatable ring of the male coaxial cable connector when the hollow member receives the male coaxial cable connector, and (b) a female coaxial cable connector when the rotatable ring is mated to the female coaxial cable connector.

16. A device for maintaining ground continuity across a male F-connector and female F-connector, the device comprising:

a sleeve having a wrench portion configured to receive a rotatable ring of the male F-connector; and a grounding element positioned at least partially within the sleeve, wherein the grounding element includes:

a first portion configured to conductively contact a sleeve of the male F-connector;

a second portion configured to conductively contact the rotatable ring of the male F-connector; and an end portion configured to conductively contact the female F-connector when the rotatable ring is mated to the female F-connector.

17. The device of claim 16 wherein the sleeve includes at least one shoulder portion configured to abut the forward edge of the rotatable ring, and wherein the end portion of the grounding element at least partially extends beyond the shoulder portion.

18. The device of claim 16 wherein the wrench portion of the sleeve includes an outer edge, and wherein the end portion of the grounding element at least partially extends beyond the outer edge.

19. The device of claim 16 wherein the end portion includes at least one projection extending radially inward and configured to engage a threaded outer surface of the female F-connector when the rotatable ring is mated to the female F-connector.

20. The device of claim 16, further comprising the male F-connector.

* * * * *